US008270887B2

(12) United States Patent
Uchiyama et al.

(10) Patent No.: US 8,270,887 B2
(45) Date of Patent: Sep. 18, 2012

(54) FIXING DEVICE, IMAGE FORMING APPARATUS, AND MAGNETIC FIELD GENERATING DEVICE HAVING A PRESSING MEMBER

(75) Inventors: Takayuki Uchiyama, Ebina (JP); Motoi Noya, Ebina (JP); Masakatsu Eda, Ebina (JP); Kiyoshi Iwai, Ebina (JP); Shuji Yoshikawa, Ebina (JP); Nobuyoshi Komatsu, Ebina (JP); Makoto Omata, Ebina (JP); Tsuyoshi Sunohara, Ebina (JP); Kazuyoshi Itoh, Ebina (JP); Motofumi Baba, Ebina (JP); Shigehiko Haseba, Ebina (JP); Eiichiro Tokuhiro, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 509 days.

(21) Appl. No.: 12/557,635

(22) Filed: Sep. 11, 2009

(65) Prior Publication Data

US 2010/0215414 A1 Aug. 26, 2010

(30) Foreign Application Priority Data

Feb. 25, 2009 (JP) ..... 2009-042802
Mar. 26, 2009 (JP) ..... 2009-075791

(51) Int. Cl.
*G03G 15/20* (2006.01)

(52) U.S. Cl. ..... 399/329; 399/328

(58) Field of Classification Search ..... 399/328, 399/329, 335, 337
See application file for complete search history.

(56) References Cited

U.S. PATENT DOCUMENTS

| | | | | |
|---|---|---|---|---|
| 7,427,729 | B2 | 9/2008 | Asakura et al. | 219/619 |
| 2003/0095818 | A1 | 5/2003 | Nakayama | |
| 2005/0244199 | A1 | 11/2005 | Nakayama | |
| 2006/0147221 | A1 | 7/2006 | Asakura et al. | 399/69 |
| 2008/0124111 | A1 | 5/2008 | Baba et al. | |
| 2008/0124147 | A1 | 5/2008 | Uehara et al. | |
| 2008/0226324 | A1 * | 9/2008 | Baba et al. | 399/69 |
| 2008/0267676 | A1 * | 10/2008 | Takai et al. | 399/335 |

FOREIGN PATENT DOCUMENTS

| | | |
|---|---|---|
| JP | 2001-244062 | 9/2001 |
| JP | 2003-186322 | 7/2003 |
| JP | 2006-267742 | 10/2006 |
| JP | 2006-269089 | 10/2006 |
| JP | 2007-132993 | 5/2007 |
| JP | 2007-264021 | 10/2007 |
| JP | 2008-129517 | 6/2008 |
| JP | 2008-152247 | 7/2008 |
| WO | WO 2004/063819 | 7/2004 |

* cited by examiner

*Primary Examiner* — Walter L Lindsay, Jr.

*Assistant Examiner* — Billy J Lactaoen

(74) *Attorney, Agent, or Firm* — Morgan, Lewis & Bockius LLP

(57) ABSTRACT

The fixing device includes: a fixing member that includes a conductive layer capable of heating by electromagnetic induction; a magnetic field generating member that generates an alternate-current magnetic field intersecting with the conductive layer of the fixing member; plural magnetic path forming members that form a magnetic path of the alternate-current magnetic field generated by the magnetic field generating member; a support member that supports the magnetic field generating member; an elastic support member that is arranged between the magnetic field generating member and the plural magnetic path forming members so as to be in contact with the plural magnetic path forming members; and a pressing member that presses the plural magnetic path forming members toward the magnetic field generating member.

16 Claims, 18 Drawing Sheets

FIXING DEVICE, IMAGE FORMING APPARATUS, AND MAGNETIC FIELD GENERATING DEVICE HAVING A PRESSING MEMBER

CROSS REFERENCE TO RELATED APPLICATIONS

This application is based on and claims priority under 35 USC §119 from Japanese Patent Applications No. 2009-042802 filed Feb. 25, 2009, and No. 2009-75791 filed Mar. 26, 2009.

BACKGROUND

1. Technical Field

The present invention relates to a fixing device, an image forming apparatus and a magnetic field generating device.

2. Related Art

Fixing devices using an electromagnetic induction heating method are known as the fixing devices each to be installed in an image forming apparatus such as a copier and a printer using an electrophotographic method.

SUMMARY

According to an aspect of the present invention, there is provided a fixing device including: a fixing member that includes a conductive layer capable of heating by electromagnetic induction; a magnetic field generating member that generates an alternate-current magnetic field intersecting with the conductive layer of the fixing member; plural magnetic path forming members that form a magnetic path of the alternate-current magnetic field generated by the magnetic field generating member; a support member that supports the magnetic field generating member; an elastic support member that is arranged between the magnetic field generating member and the plural magnetic path forming members so as to be in contact with the plural magnetic path forming members; and a pressing member that presses the plural magnetic path forming members toward the magnetic field generating member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below in detail with reference to the accompanying drawings.

<Description of Image Forming Apparatus>

Figure 1:
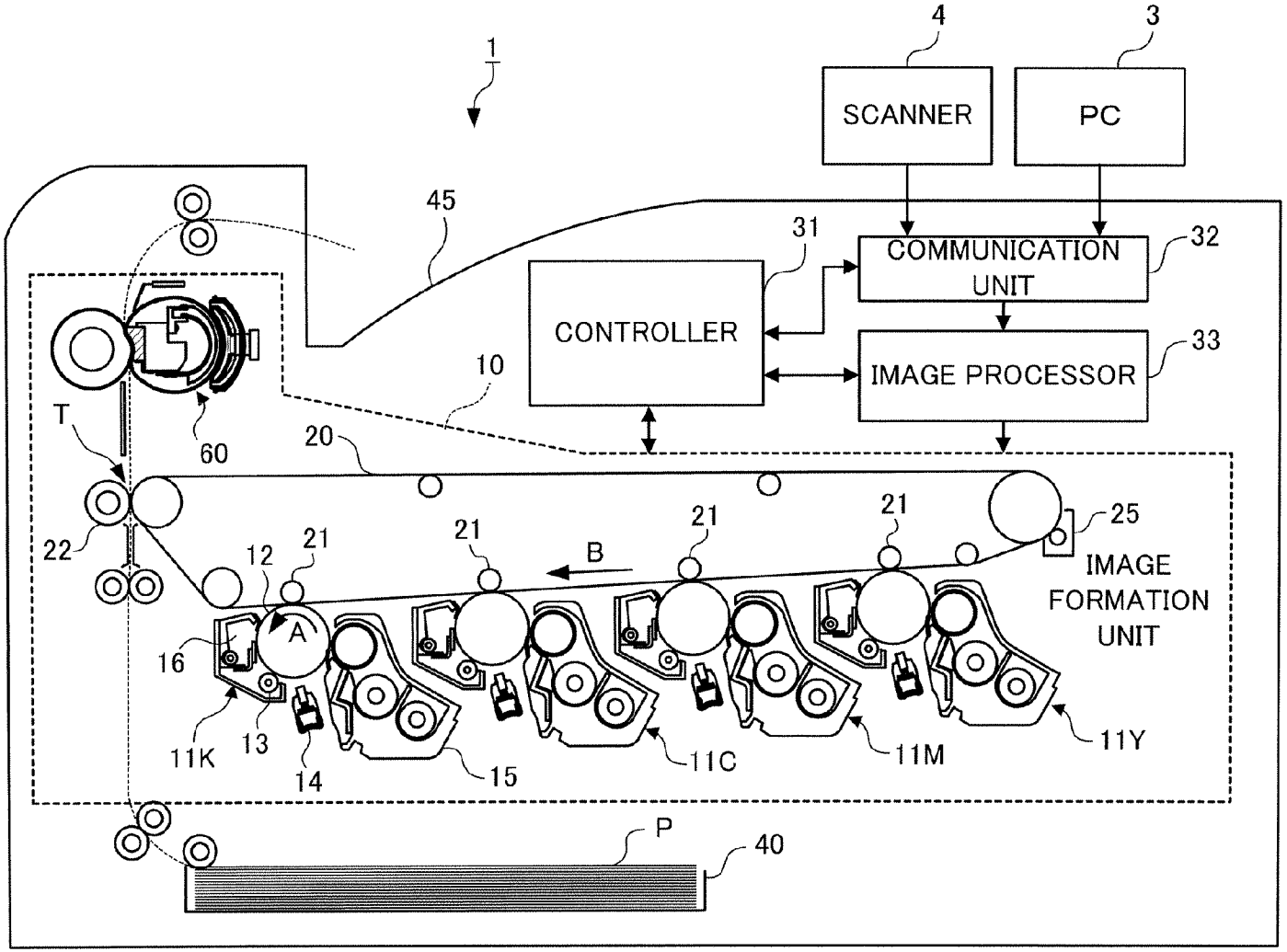
FIG. 1 is a diagram showing a configuration example of an image forming apparatus having a fixing device to which the exemplary embodiments are applied.

FIG. 1 is a diagram showing a configuration example of an image forming apparatus to which a fixing device of the exemplary embodiments is applied. An image forming apparatus 1 shown in FIG. 1 is a so-called tandem-type color printer, and includes: an image formation unit 10 that performs image formation on the basis of image data; and a controller 31 that controls operations of the entire image forming apparatus 1. The image forming apparatus 1 further includes: a communication unit 32 that communicates with, for example, a personal computer (PC) 3, an image reading apparatus (scanner) 4 or the like to receive image data; and an image processor 33 that performs image processing set in advance on image data received by the communication unit 32.

The image formation unit 10 includes four image forming units 11Y, 11M, 11C and 11K (also collectively referred to as an "image forming unit 11") as example of a toner image forming unit, which are arranged side by side at certain intervals. Each of the image forming units 11 includes: a photoconductive drum 12 as an example of an image carrier that forms an electrostatic latent image and holds a toner image; a charging device 13 that uniformly charges the surface of the photoconductive drum 12 at a predetermined potential; a light emitting diode (LED) print head 14 that exposes, on the basis of color image data, the photoconductive drum 12 charged by the charging device 13; a developing device 15 that develops the electrostatic latent image formed on the photoconductive drum 12; and a drum cleaner 16 that cleans the surface of the photoconductive drum 12 after the transfer.

The image forming units 11 have almost the same configuration except toner contained in the developing device 15, and form yellow (Y), magenta (M), cyan (C) and black (K) color toner images, respectively.

Further, the image formation unit 10 includes: an intermediate transfer belt 20 onto which multiple layers of color toner images formed on the photoconductive drums 12 of the image forming units 11 are transferred; and primary transfer rolls 21 that sequentially transfer (primarily transfer) color toner images formed in respective image forming units 11 onto the intermediate transfer belt 20. Furthermore, the image formation unit 10 includes: a secondary transfer roll 22 that collectively transfers (secondarily transfers) the color toner images superimposingly transferred onto the intermediate transfer belt 20 onto a sheet P which is a recording medium (recording sheet); and a fixing unit 60 as an example of a fixing unit (a fixing device) that fixes the color toner images having been secondarily transferred, onto the sheet P. Note that, in the image forming apparatus 1 according to the exemplary embodiments, the intermediate transfer belt 20, the primary transfer rolls 21 and the secondary transfer roll 22 configure a transfer unit.

In the image forming apparatus 1 of the exemplary embodiments, image formation processing using the following processes is performed under operations controlled by the controller 31. Specifically, image data from the PC 3 or the scanner 4 is received by the communication unit 32, and after the image data is subjected to certain image processing performed by the image processor 33, the image data of each color is generated and sent to a corresponding one of the image forming units 11. Then, in the image forming unit 11K that forms a black-color (K) toner image, for example, the photoconductive drum 12 is uniformly charged by the charging device 13 at the potential set in advance while rotating in a direction of an arrow A, and then is scanned and exposed by the LED print head 14 on the basis of the K color image data transmitted from the image processor 33. Thereby, an electrostatic latent image for the black-color image is formed on the photoconductive drum 12. The black-color electrostatic latent image formed on the photoconductive drum 12 is then developed by the developing device 15. Then, the black-color toner image is formed on the photoconductive drum 12. In the same manner, yellow (Y), magenta (M) and cyan (C) color toner images are formed in the image forming units 11Y, 11M and 11C, respectively.

The color toner images formed on the respective photoconductive drums 12 in the image forming units 11 are electrostatically transferred (primarily transferred), in sequence, onto the intermediate transfer belt 20 that moves in a direction of an arrow B by the primary transfer rolls 21. Then, superimposed toner images on which the color toner images are superimposed on one another are formed. Then, the superimposed toner images on the intermediate transfer belt 20 are transported to a region (secondary transfer portion T) at which the secondary transfer roll 22 is arranged, along with the movement of the intermediate transfer belt 20. The sheet P is supplied from a sheet holding unit 40 to the secondary transfer portion T at a timing when the superimposed toner images being transported arrive at the secondary transfer portion T. Then, the superimposed toner images are collectively and electrostatically transferred (secondarily transferred) onto the transported sheet P by action of a transfer electric field formed at the secondary transfer portion T by the secondary transfer roll 22.

Thereafter, the sheet P onto which the superimposed toner images are electrostatically transferred is transported toward the fixing unit 60. The toner images on the sheet P transported to the fixing unit 60 are heated and pressurized by the fixing unit 60 and thereby are fixed onto the sheet P. Then, the sheet P including the fixed images formed thereon is transported to a sheet output unit 45 provided at an output portion of the image forming apparatus 1.

Meanwhile, the toner (primary-transfer residual toner) attached to the photoconductive drums 12 after the primary transfer and the toner (secondary-transfer residual toner) attached to the intermediate transfer belt 20 after the secondary transfer are removed by the drum cleaners 16 and a belt cleaner 25, respectively.

In this way, the image formation processing in the image forming apparatus 1 is repeatedly performed for a designated number of print sheets.

<Description of Configuration of Fixing Unit>

Next, a description will be given of the fixing unit 60 in the exemplary embodiments.

Figure 2:
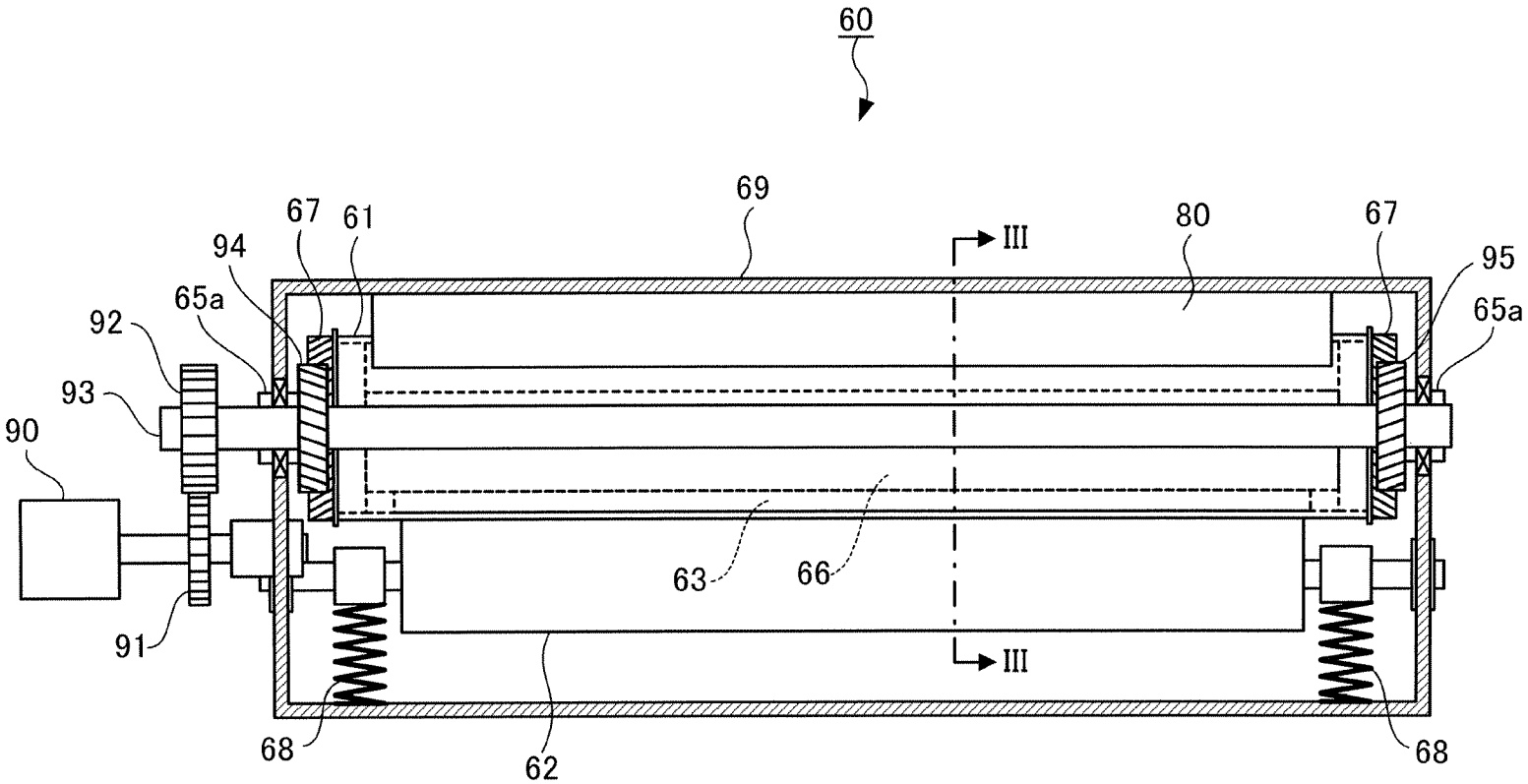
FIG. 2 is a front view of the fixing unit to which the exemplary embodiments are applied.
Figure 3:
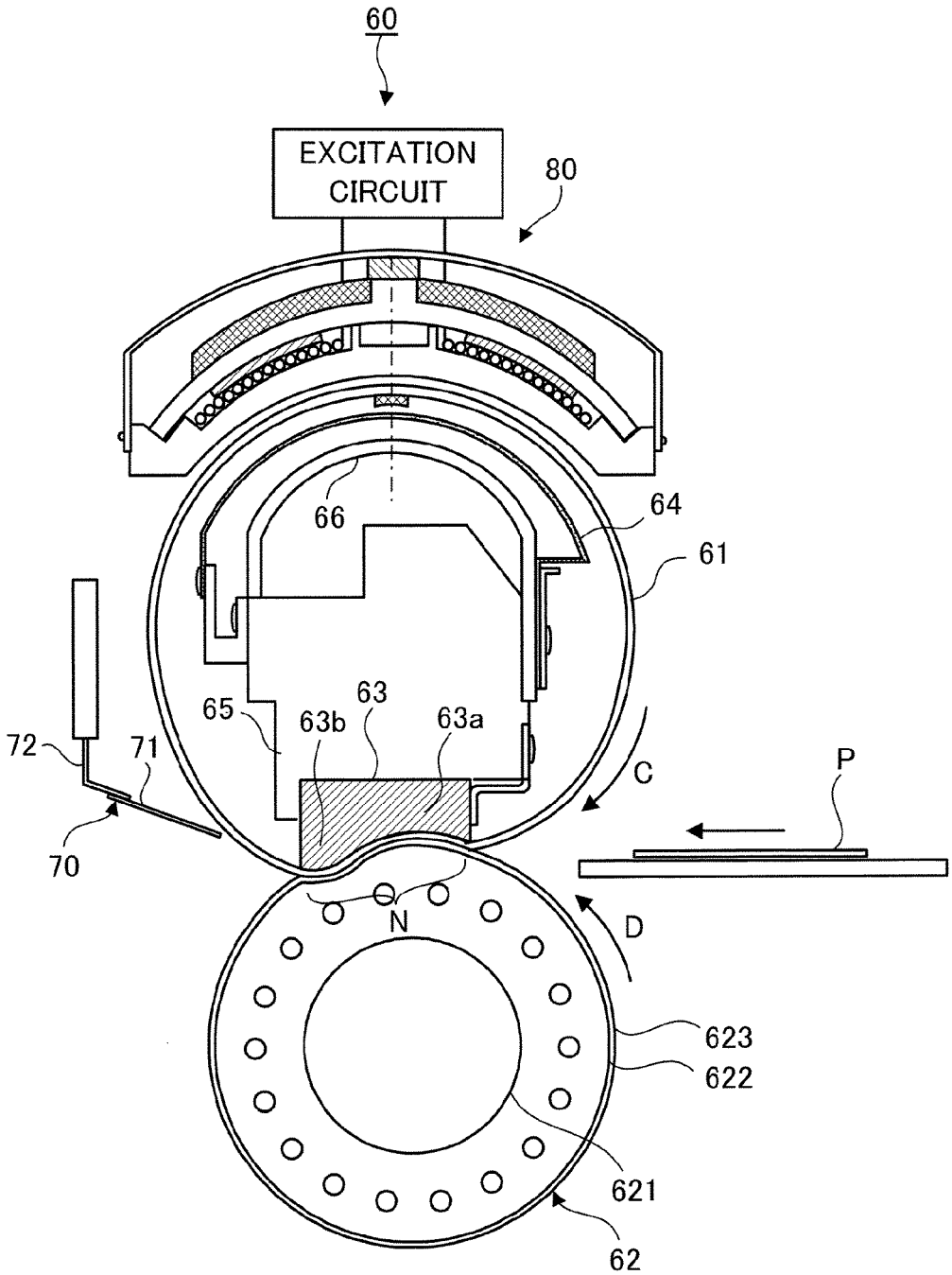
FIG. 3 is a cross sectional view of the fixing unit, taken along the line III-III in FIG. 2.

FIGS. 2 and 3 are diagrams showing a configuration of the fixing unit 60 of the exemplary embodiments. FIG. 2 is a front view of the fixing unit 60, and FIG. 3 is a cross sectional view of the fixing unit 60, taken along the line III-III in FIG. 2.

Firstly, as shown in FIG. 3, which is a cross sectional view, the fixing unit 60 includes: an induction heating (IH) heater 80 as an example of a magnetic field generating device that generates an AC (alternate-current) magnetic field; a fixing belt 61 as an example of a fixing member that is subjected to electromagnetic induction heating by the IH heater 80, and thereby fixes a toner image; a pressure roll 62 that is arranged in a manner to face the fixing belt 61; and a pressing pad 63 that is pressed by the pressure roll 62 with the fixing belt 61 therebetween.

The fixing unit 60 further includes: a holder 65 that supports a constituent member such as the pressing pad 63; a temperature-sensitive magnetic member 64 that forms an opposed magnetic path by inducing the AC magnetic field generated at the IH heater 80; an induction member 66 that induces magnetic field lines passing through the temperature-sensitive magnetic member 64; and a peeling assisting member 70 that assists peeling of the sheet P from the fixing belt 61.

<Description of Fixing Belt>

Figure 4:
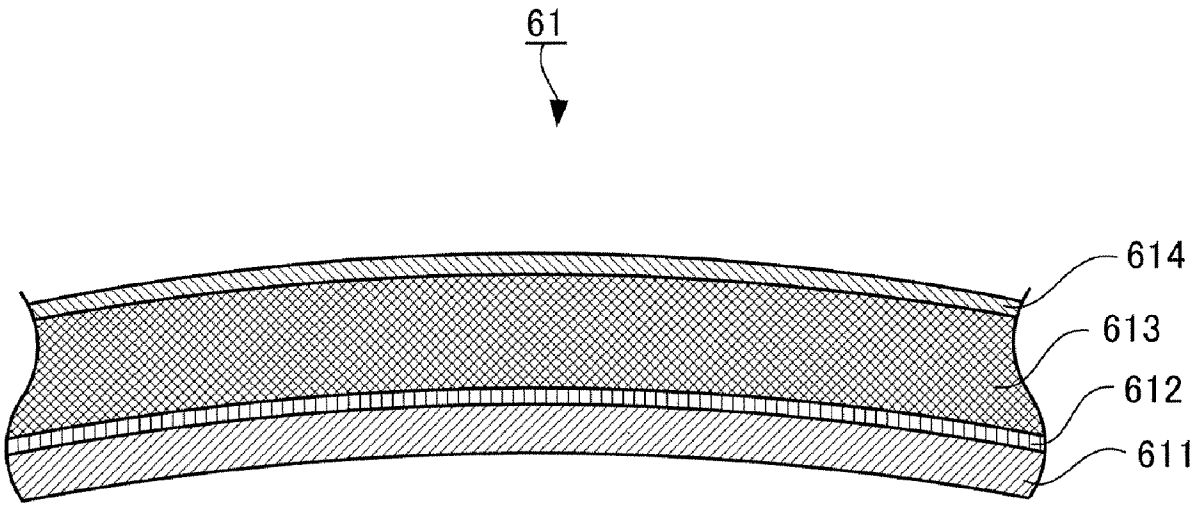
FIG. 4 is a configuration diagram showing cross sectional layers of the fixing belt.

The fixing belt 61 is formed of an endless belt member originally formed into a cylindrical shape, and is formed with a diameter of 30 mm and a width-direction length of 300 mm in the original shape (cylindrical shape), for example. In addition, as shown in FIG. 4 (a configuration diagram showing cross sectional layers of the fixing belt 61), the fixing belt 61 is a belt member having a multi-layer structure including: a base layer 611; a conductive heat-generating layer 612 that is coated on the base layer 611; an elastic layer 613 that improves fixing properties of a toner image; and a surface release layer 614 that is applied as the uppermost layer.

The base layer 611 is formed of a heat-resistant sheet-like member that supports the conductive heat-generating layer 612, which is a thin layer, and that gives a mechanical strength to the entire fixing belt 61. Moreover, the base layer 611 is formed of a specified material with a specified thickness. The base layer material has properties (relative permeability, specific resistance) that allow a magnetic field to pass therethrough so that the AC magnetic field generated at the IH heater 80 may act on the temperature-sensitive magnetic member 64. Meanwhile, the base layer 611 itself is formed so as not to generate heat by action of the magnetic field or not to easily generate heat.

Specifically, for example, a non-magnetic metal such as a non-magnetic stainless steel having a thickness of 30 to 200

μm (preferably, 50 to 150 μm), or a resin material or the like having a thickness of 60 to 200 μm is used as the base layer 611.

The conductive heat-generating layer 612 is an example of a conductive layer and is an electromagnetic induction heat-generating layer that heats by electromagnetic induction of the AC magnetic field generated at the IH heater 80. Specifically, the conductive heat-generating layer 612 is a layer that generates an eddy current when the AC magnetic field from the IH heater 80 passes therethrough in the thickness direction.

Normally, an inexpensively manufacturable general-purpose power supply is used as the power supply for an excitation circuit that supplies an AC current to the IH heater 80 (also refer to later described FIG. 6). For this reason, in general, a frequency of the AC magnetic field generated by the IH heater 80 ranges from 20 kHz to 100 kHz by use of the general-purpose power supply. Accordingly, the conductive heat-generating layer 612 is formed to allow the AC magnetic field having a frequency of 20 kHz to 100 kHz to enter and to pass therethrough.

A region of the conductive heat-generating layer 612, where the AC magnetic field is allowed to enter is defined as a "skin depth (δ)" representing a region where the AC magnetic field attenuates to 1/e. The skin depth (δ) is calculated by use of the following formula (1), where f is a frequency of the AC magnetic field (20 kHz, for example), ρ is a specific resistance value (Ω·m), and $\mu_r$ is a relative permeability.

Accordingly, in order to allow the AC magnetic field having a frequency of 20 kHz to 100 kHz to enter and then to pass through the conductive heat-generating layer 612, the thickness of the conductive heat-generating layer 612 is formed to be smaller than the skin depth (δ) of the conductive heat-generating layer 612, which is defined by the formula (1). In addition, as the material that forms the conductive heat-generating layer 612, a metal such as Au, Ag, Al, Cu, Zn, Sn, Pb, Bi, Be or Sb, or a metal alloy including at least one of these elements is used, for example.

$$\delta = 503\sqrt{\frac{\rho}{f \cdot \mu_r}} \tag{1}$$

Specifically, as the conductive heat-generating layer 612, a non-magnetic metal (having a relative permeability substantially equal to 1) including Cu or the like, having a thickness of 2 to 20 μm and a specific resistance value not greater than $2.7\times10^{-8}$ Ω·m is used, for example.

In addition, in view of shortening the period of time required for heating the fixing belt 61 to reach a fixation setting temperature (hereinafter, referred to as a "warm-up time") as well, the conductive heat-generating layer 612 may be formed of a thin layer.

Next, the elastic layer 613 is formed of a heat-resistant elastic material such as a silicone rubber. The toner image to be held on the sheet P, which is to become the fixation target, is formed of a multi-layer of color toner as powder. For this reason, in order to uniformly supply heat to the entire toner image at a nip portion N, the surface of the fixing belt 61 may particularly be deformed so as to correspond with unevenness of the toner image on the sheet P. In this respect, a silicone rubber having a thickness of 100 to 600 μm and a hardness of 10° to 30° (JIS-A), for example, may be used for the elastic layer 613.

The surface release layer 614 directly contacts with an unfixed toner image held on the sheet P. Accordingly, a material with a high releasing property is used. For example, a PFA (a copolymer of tetrafluoroethylene and perfluoroalkylvinylether) layer, a PTFE (polytetrafluoroethylene) layer or a silicone copolymer layer or a composite layer formed of these layers is used. As to the thickness of the surface release layer 614, if the thickness is too small, no sufficient wear resistance is obtained, hence, reducing the life of the fixing belt 61. On the other hand, if the thickness is too large, the heat capacity of the fixing belt 61 becomes so large that the warm-up time becomes longer. In this respect, the thickness of the surface release layer 614 may be particularly 1 to 50 μm in consideration of the balance between the wear resistance and heat capacity.

<Description of Pressing Pad>

The pressing pad 63, which is an example of a pressing member, is formed of an elastic material such as a silicone rubber or fluorine rubber, and is supported by the holder 65 at a position facing the pressure roll 62. Then, the pressing pad 63 is arranged in a state of being pressed by the pressure roll 62 with the fixing belt 61 therebetween, and forms the nip portion N with the pressure roll 62.

In addition, the pressing pad 63 has different nip pressures set for a pre-nip region 63*a* on the sheet entering side of the nip portion N (upstream side in the transport direction of the sheet P) and a peeling nip region 63*b* on the sheet exit side of the nip portion N (downstream side in the transport direction of the sheet P), respectively. Specifically, a surface of the pre-nip region 63*a* at the pressure roll 62 side is formed into a circular arc shape approximately corresponding with the outer circumferential surface of the pressure roll 62, and the nip portion N, which is uniform and wide, is formed. Moreover, a surface of the peeling nip region 63*b* at the pressure roll 62 side is formed into a shape so as to be locally pressed with a larger nip pressure from the surface of the pressure roll 62 in order that a curvature radius of the fixing belt 61 passing through the nip portion N of the peeling nip region 63*b* may be small. Thereby, a curl (down curl) in a direction in which the sheet P is separated from the surface of the fixing belt 61 is formed on the sheet P passing through the peeling nip region 63*b*, thereby promoting the peeling of the sheet P from the surface of the fixing belt 61.

Note that, in the exemplary embodiments, the peeling assisting member 70 is arranged at the downstream side of the nip portion N as an assistance unit for the peeling of the sheet P by the pressing pad 63. In the peeling assisting member 70, a peeling baffle 71 is supported by a holder 72 in a state of being positioned to be close to the fixing belt 61 in a direction opposite to the rotational moving direction of the fixing belt 61 (so-called counter direction). Then, the peeling baffle 71 supports the curl portion formed on the sheet P at the exit of the pressing pad 63, thereby preventing the sheet P from moving toward the fixing belt 61.

<Description of Temperature-Sensitive Magnetic Member>

Next, the temperature-sensitive magnetic member 64 is formed into a circular arc shape corresponding with an inner circumferential surface of the fixing belt 61 and is arranged to be close to, but not to be in contact with the inner circumferential surface of the fixing belt 61 so as to have a predetermined gap (0.5 to 1.5 mm, for example) with the inner circumferential surface of the fixing belt 61. The reason for arranging the temperature-sensitive magnetic member 64 so as to be close to the fixing belt 61 is to achieve a configuration in which the temperature of the temperature-sensitive magnetic member 64 changes in accordance with the temperature of the fixing belt 61, that is, the temperature of the temperature-sensitive magnetic member 64 becomes substantially equal to the temperature of the fixing belt 61. In addition, the reason for arranging the temperature-sensitive magnetic member 64 so as not to be in contact with the fixing belt 61 is to suppress heat of the fixing belt 61 flowing into the temperature-sensitive magnetic member 64 when the fixing belt 61 is heated up to the fixation setting temperature after the main switch of the image forming apparatus 1 is turned on, and thereby to achieve shortening of the warm up time.

Moreover, the temperature-sensitive magnetic member 64 is formed of a material whose "permeability change start temperature" (refer to later part of the description) is not less than the fixation setting temperature at which each color toner image starts melting, and whose permeability change start temperature is also set within a temperature range lower than the heat-resistant temperatures of the elastic layer 613 and the surface release layer 614 of the fixing belt 61. Specifically, the temperature-sensitive magnetic member 64 is formed of a material having a property ("temperature-sensitive magnetic property") that reversibly changes between the ferromagnetic property and the non-magnetic property (paramagnetic property) in a temperature range including the fixation setting temperature. Thus, the temperature-sensitive magnetic member 64 functions as an opposed magnetic path forming member. Further, within the temperature range not greater than the permeability change start temperature, where the temperature-sensitive magnetic member 64 has the ferromagnetic property, the temperature-sensitive magnetic member 64 induces magnetic field lines generated by the IH heater 80 and going through the fixing belt 61 to the inside thereof, and forms a magnetic path so that the magnetic field lines may pass through the inside of the temperature-sensitive magnetic member 64. Thereby, the temperature-sensitive magnetic member 64 forms a closed magnetic path that internally wraps the fixing belt 61 and an excitation coil 82 (refer to later-described FIG. 6) of the IH heater 80. Meanwhile, within a temperature range exceeding the permeability change start temperature, the temperature-sensitive magnetic member 64 causes the magnetic field lines generated by the IH heater 80 and going through the fixing belt 61 to go therethrough so as to run across the temperature-sensitive magnetic member 64 in the thickness direction of the temperature-sensitive magnetic member 64. Then, the magnetic field lines generated by the IH heater 80 and going through the fixing belt 61 form a magnetic path in which the magnetic field lines go through the temperature-sensitive magnetic member 64, and then pass through the inside of the induction member 66 and return to the IH heater 80.

Note that, the "permeability change start temperature" herein refers to a temperature at which a permeability (permeability measured by JIS C2531, for example) starts decreasing continuously and refers to a temperature point at which the amount of the magnetic flux (the number of magnetic field lines) going through a member such as the temperature-sensitive magnetic member 64 starts to change, for example. Accordingly, the permeability change start temperature is a temperature close to the Curie point, which is a temperature as a boundary at which the magnetic property of the substance is lost, but is a temperature with a concept different from the Curie point.

Examples of the material of the temperature-sensitive magnetic member 64 include a binary temperature-sensitive magnetic alloy such as a Fe—Ni alloy (permalloy) or a ternary temperature-sensitive magnetic alloy such as a Fe—Ni—Cr alloy whose permeability change start temperature is set within a range of 140 degrees C. (the fixation setting temperature) to 240 degrees C. For example, the permeability change start temperature may be set around 225 degrees C. by setting the ratios of Fe and Ni at approximately 64% and 36% (atom number ratio), respectively, in a binary temperature-sensitive magnetic alloy of Fe—Ni. The aforementioned metal alloys or the like including the permalloy and the temperature-sensitive magnetic alloy are suitable for the temperature-sensitive magnetic member 64 since they are excellent in molding property and processability, and a high heat conductivity as well as less expensive costs. Another example of the material includes a metal alloy made of Fe, Ni, Si, B, Nb, Cu, Zr, Co, Cr, V, Mn, Mo or the like.

In addition, the temperature-sensitive magnetic member 64 is formed with a thickness larger than the skin depth δ (refer to the formula (1) described above) with respect to the AC magnetic field (magnetic field lines) generated by the IH heater 80. Specifically, a thickness of approximately 50 to 300 μm is set when a Fe—Ni alloy is used as the material, for example. Note that, the configuration and the function of the temperature-sensitive magnetic member 64 will be described later in detail.

<Description of Holder>

The holder 65 that supports the pressing pad 63 is formed of a material having a high rigidity so that the amount of deflection in a state where the pressing pad 63 receives pressing force from the pressure roll 62 may be a certain amount or less. In this manner, the amount of pressure (nip pressure N) at the nip portion N in the longitudinal direction is kept uniform. Moreover, since the fixing unit 60 of the exemplary embodiments employs a configuration in which the fixing belt 61 heats by use of electromagnetic induction, the holder 65 is formed of a material that provides no influence or hardly provides influence to an induction magnetic field, and that is not influenced or is hardly influenced by the induction magnetic field. For example, a heat-resistant resin such as glass mixed PPS (polyphenylene sulfide), or a non-magnetic metal material such as Al, Cu or Ag is used.

<Description of Induction Member>

The induction member 66 is formed into a circular arc shape corresponding with the inner circumferential surface of the temperature-sensitive magnetic member 64 and is arranged so as not to be in contact with the inner circumferential surface of the temperature-sensitive magnetic member 64. Here, the induction member 66 has a gap set in advance (1.0 to 5.0 mm, for example) with the inner circumferential surface of the temperature-sensitive magnetic member 64. The induction member 66 is formed of, for example, a non-magnetic metal such as Ag, Cu and Al having a relatively small specific resistance. When the temperature of temperature-sensitive magnetic member 64 increases to a temperature not less than the permeability change start temperature, the induction member 66 induces an AC magnetic field (magnetic field lines) generated at the IH heater 80 and thereby forms a state where an eddy current I is more easily generated in comparison with the conductive heat generating layer 612 of the fixing belt 61. For this reason, the thickness of the induction member 66 is formed to be a thickness set in advance (1.0 mm, for example) sufficiently larger than the skin depth δ (refer to the aforementioned formula (1)) so as to allow the eddy current I to easily flow therethrough.

<Description of Drive Mechanism of Fixing Belt>

Next, a description will be given of a drive mechanism of the fixing belt 61.

As shown in FIG. 2, which is a front view, end caps 67 are secured to both ends in the axis direction of the holder 65 (refer to FIG. 3), respectively. The end caps 67 rotationally drive the fixing belt 61 in a circumferential direction while keeping cross sectional shapes of both ends of the fixing belt 61 in a circular shape. Then, the fixing belt 61 directly receives rotational drive force via the end caps 67 at the both ends and rotationally moves at, for example, a process speed of 140 mm/s in a direction of an arrow C in FIG. 3

Figure 5A:
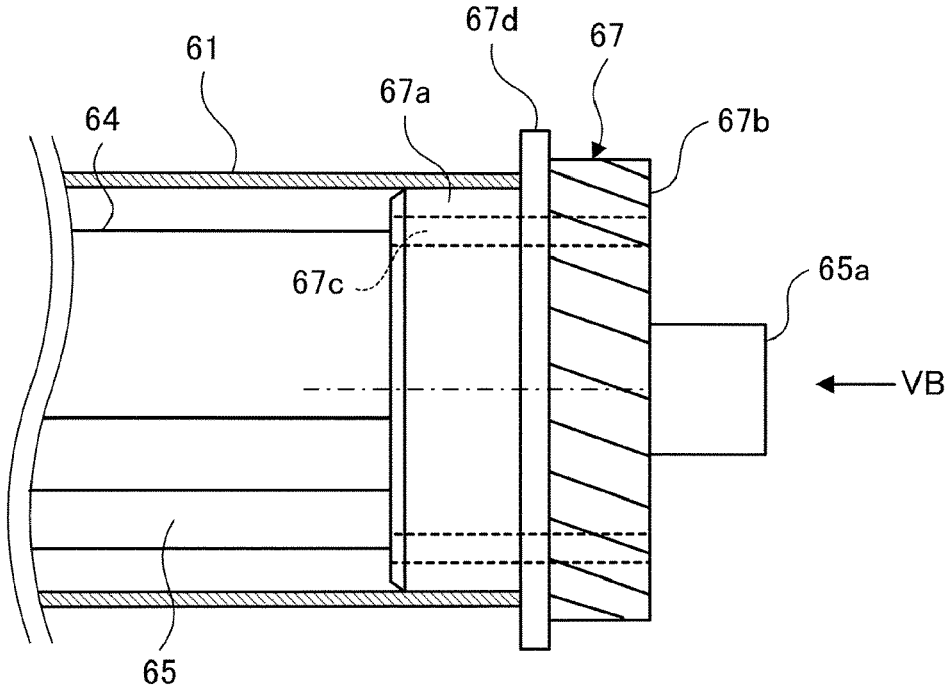
FIG. 5A is a side view of one of the end caps.
Figure 5B:
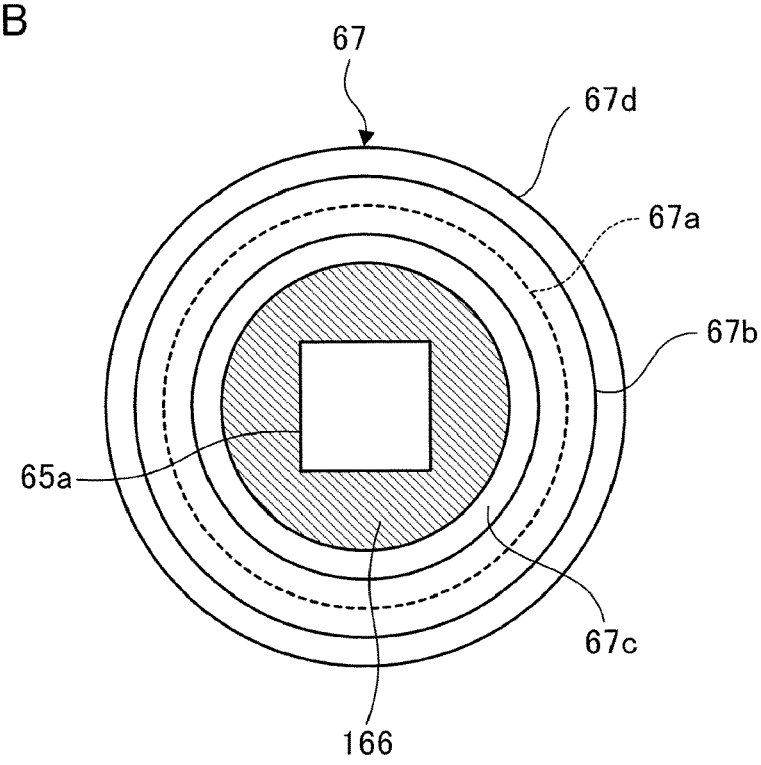
FIG. 5B is a plain view of the end cap when viewed from a VB direction.

Here, FIG. 5A is a side view of one of the end caps 67, and FIG. 5B is a plain view of the end cap 67 when viewed from a VB direction of FIG. 5A. As shown in FIGS. 5A and 5B, the end cap 67 includes: a fixing unit 67*a* that is fitted into the inside of a corresponding one of the ends of the fixing belt 61; a flange 67*d* that has an outer diameter formed larger than that of the fixing unit 67*a* and that is formed so as to project from the fixing belt 61 in the radial direction when attached to the fixing belt 61; a gear 67*b* to which the rotational drive force is transmitted; and a bearing unit 67*c* that is rotatably connected to a support member 65*a* formed at a corresponding one of the ends of the holder 65 with a connection member 166 interposed therebetween. Then, as shown in FIG. 2, the support members 65*a* at the both ends of the holder 65 are secured onto the both ends of a chassis 69 of the fixing unit 60, respectively, thereby, supporting the end caps 67 so as to be rotatable with the bearing units 67*c* respectively connected to the support members 65*a*.

As the material of the end caps 67, so called engineering plastics having a high mechanical strength or heat-resistant properties is used. For example, a phenol resin, polyimide resin, polyamide resin, polyamide-imide resin, PEEK resin, PES resin, PPS resin, LCP resin or the like is suitable.

Then, as shown in FIG. 2, in the fixing unit 60, rotational drive force from a drive motor 90 is transmitted to a shaft 93 via transmission gears 91 and 92. The rotational drive force is then transmitted from transmission gears 94 and 95 connected to the shaft 93 to the gears 67*b* of the respective end caps 67 (refer to FIGS. 5A and 5B). Thereby, the rotational drive force is transmitted from the end caps 67 to the fixing belt 61, and the end caps 67 and the fixing belt 61 are integrally driven to rotate.

As described above, the fixing belt 61 directly receives the drive force at the both ends of the fixing belt 61 to rotate, thereby rotating stably.

Here, a torque of approximately 0.1 to 0.5 N·m is generally exerted when the fixing belt 61 directly receives the drive force from the end caps 67 at the both ends thereof and then rotates. However, in the fixing belt 61 of the exemplary embodiments, the base layer 611 is formed of, for example, a non-magnetic stainless steel having a high mechanical strength. Thus, buckling or the like does not easily occur on the fixing belt 61 even when a torsional torque of approximately 0.1 to 0.5 N·m is exerted on the entire fixing belt 61.

In addition, the fixing belt 61 is prevented from inclining or leaning to one direction by the flanges 67*d* of the end caps 67, but at this time, compressive force of approximately 1 to 5 N is exerted toward the axis direction from the ends (flanges 67*d*) on the fixing belt 61 in general. However, even in a case where the fixing belt 61 receives such compressive force, the occurrence of buckling or the like is prevented since the base layer 611 of the fixing belt 61 is formed of a non-magnetic stainless steel or the like.

As described above, the fixing belt 61 of the exemplary embodiments receives the drive force directly at the both ends of the fixing belt 61 to rotate, thereby, rotating stably. In addition, the base layer 611 of the fixing belt 61 is formed of, for example, a non-magnetic stainless steel or the like having a high mechanical strength, hence providing the configuration in which buckling or the like caused by a torsion torque or compressive force does not easily occur in this case. Moreover, the softness and flexibility of the entire fixing belt 61 is obtained by forming the base layer 611 and the conductive heat-generating layer 612 respectively as thin layers, so that the fixing belt 61 is deformed so as to correspond with the nip portion N and recovers to the original shape.

With reference back to FIG. 3, the pressure roll 62 is arranged to face the fixing belt 61 and rotates at, for example, a process speed of 140 mm/s in the direction of an arrow D in FIG. 3 while being driven by the fixing belt 61. Then, the nip portion N is formed in a state where the fixing belt 61 is held between the pressure roll 62 and the pressing pad 63. Then, while the sheet P holding an unfixed toner image is caused to pass through this nip portion N, heat and pressure is applied to the sheet P, and thereby, the unfixed toner image is fixed onto the sheet P.

The pressure roll 62 is formed of a multi-layer including: a solid aluminum core (cylindrical core metal) 621 having a diameter of 18 mm, for example; a heat-resistant elastic layer 622 that covers the outer circumferential surface of the core 621, and that is made of silicone sponge having a thickness of 5 mm, for example; and a release layer 623 that is formed of a heat-resistant resin such as PFA containing carbon or the like, or a heat-resistant rubber, having a thickness of 50 μm, for example, and that covers the heat-resistant elastic layer 622. Then, the pressing pad 63 is pressed under a load of 20 kgf for example, by pressing springs 68 (refer to FIG. 2) with the fixing belt 61 therebetween.

First Exemplary Embodiment

Next, a description will be given of an example of the IH heater 80 included in the fixing unit 60 in the first exemplary embodiment.

<Description of IH Heater>

Figure 6:
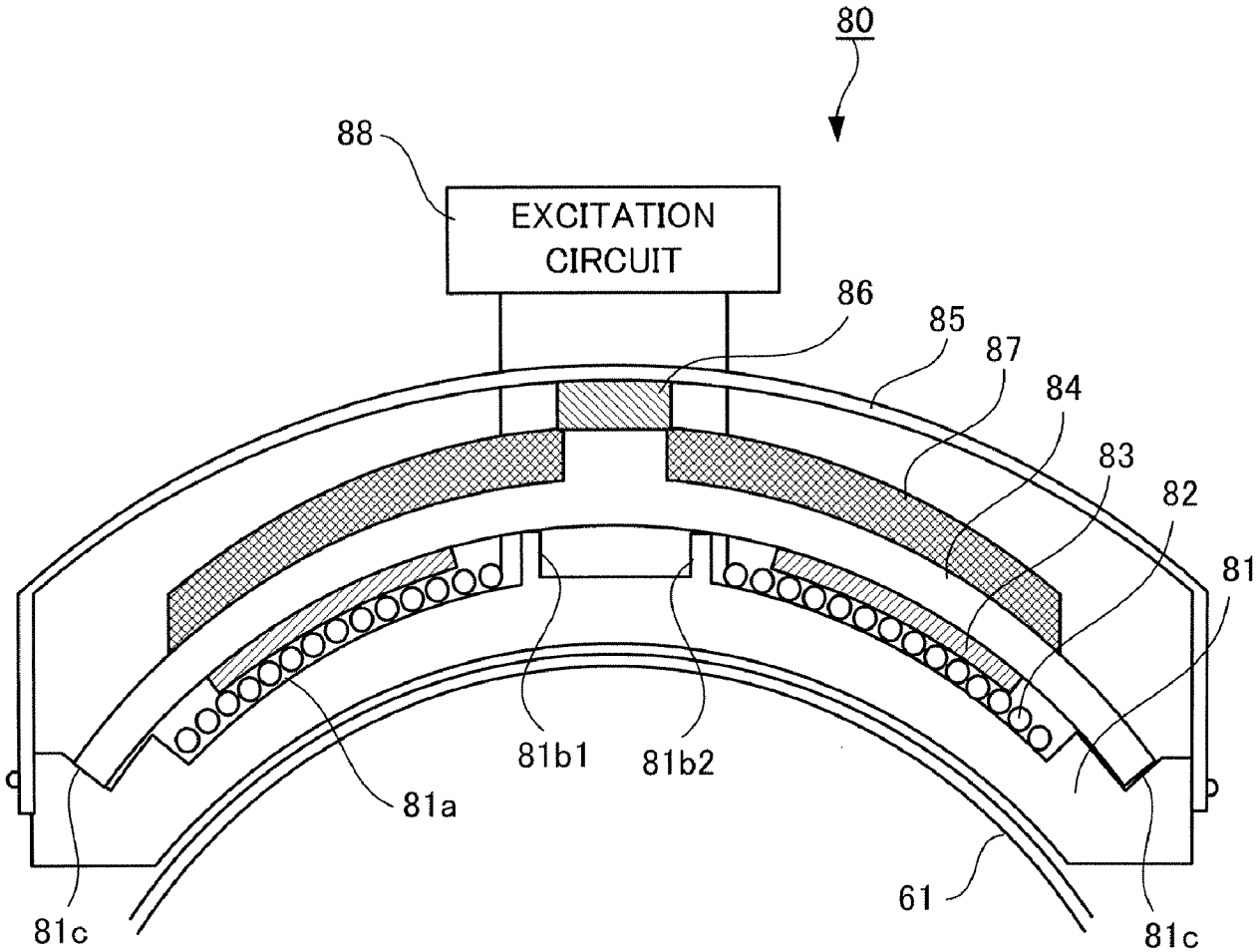
FIG. 6 is a cross sectional view for explaining a configuration of the IH heater.

FIG. 6 is a cross sectional view for explaining a configuration of the IH heater 80 in the first exemplary embodiment. As shown in FIG. 6, the IH heater 80, for example, includes: a support member 81 as a support member that is formed of a non-magnetic material such as a heat-resistant resin; and an excitation coil 82 as a magnetic field generating member that generates an AC magnetic field. The IH heater 80 also includes: sheet-like elastic support members 83 each formed of an elastic material that secures the excitation coil 82 onto the support member 81; and magnetic cores 84 each being as plural magnetic path forming members that forms a magnetic path of the AC magnetic field generated by the excitation coil 82. The IH heater 80 further includes: a pressing member 86 that presses the magnetic cores 84 against the support member 81; magnetic core holders 87 each being as a cover material of the magnetic core 84; a shield 85 as a shield member that is attached to the support member 81 to press the pressing member 86 and to shield a magnetic field at the same time; and an excitation circuit 88 that supplies an AC current to the excitation coil 82. As will be described later, each of the sheet-like elastic support members 83 is formed in a sheet like shape continuous in the axis direction of the fixing belt 61 so as to be provided between the excitation coil 82 and the magnetic cores 84 and to be in contact with multiple magnetic cores 84.

The support member 81 is formed into a shape in which the cross section thereof is curved along the shape of the surface of the fixing belt 61, and is formed so as to keep a gap set in advance (0.5 to 2 mm, for example) between an upper surface (supporting surface) 81*a* that supports the excitation coil 82 and the surface of the fixing belt 61. In addition, examples of the material that forms the support member 81 include a heat-resistant non-magnetic material such as: a heat-resistant glass; a heat-resistant resin including polycarbonate, polyethersulphone or PPS (polyphenylene sulfide); and the heat-resistant resin containing a glass fiber therein.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

Each of the magnetic cores 84 functions as a magnetic path forming unit. As the material of the magnetic core 84, a ferromagnetic material formed of an oxide or alloy material having a high permeability such as soft ferrite, a ferrite resin, a non-crystalline alloy (amorphous alloy), permalloy or temperature-sensitive magnetic alloy is used.

The magnetic core 84 forms a path (magnetic path) of magnetic field lines. This path (magnetic path) of magnetic field lines induces magnetic field lines (magnetic flux) of the AC magnetic field generated by the excitation coil 82 to the inside thereof, then runs across the fixing belt 61 from the magnetic core 84, then moves toward the direction of the temperature-sensitive magnetic member 64 and returns to the magnetic core 84 after passing through the inside of the temperature-sensitive magnetic member 64.

Specifically, a configuration in which the AC magnetic field generated by the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coils 82 is formed. Thereby, the magnetic field lines of the AC magnetic field generated by the excitation coil 82 are concentrated at a region of the fixing belt 61, the region facing the magnetic cores 84.

Here, the material of the magnetic core 84 may be one that has a small amount of loss due to the formation of the magnetic path. Specifically, the magnetic core 84 may be used in a form that gives reduction of the amount of eddy-current loss (shielding or dividing of the electric current path by having a slit or the like, or bundling of thin plates, or the like). In addition, the magnetic core 84 may be particularly formed of a material having a small hysteresis loss.

The length of the magnetic core 84 in the rotation direction of the fixing belt 61 is formed to be shorter than the length of the temperature-sensitive magnetic member 64 in the rotation direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit 60 is also suppressed, and the heat-generating efficiency at the fixing belt 61 (conductive heat-generating layer 612) increases.

<Description of a State in which Fixing Belt Generates Heat>

Next, a description will be given of a state in which the fixing belt 61 generates heat by use of the AC magnetic field generated by the IH heater 80.

Firstly, as described above, the permeability change start temperature of the temperature-sensitive magnetic member 64 is set within a temperature range (140 to 240 degrees C., for example) where the temperature is not less than the fixation setting temperature for fixing color toner images and not greater than the heat-resistant temperature of the fixing belt 61. Then, when the temperature of the fixing belt 61 is not greater than the permeability change start temperature, the temperature of the temperature-sensitive magnetic member 64 near the fixing belt 61 corresponds to the temperature of the fixing belt 61 and then becomes equal to or lower than the permeability change start temperature. For this reason, the temperature-sensitive magnetic member 64 has a ferromagnetic property at this time, and thus, the magnetic field lines H of the AC magnetic field generated by the IH heater 80 form a magnetic path where the magnetic field lines H go through the fixing belt 61 and thereafter, pass through the inside of the temperature-sensitive magnetic member 64 along a spreading direction. Here, the "spreading direction" refers to a direction orthogonal to the thickness direction of the temperature-sensitive magnetic member 64.

Figure 7:
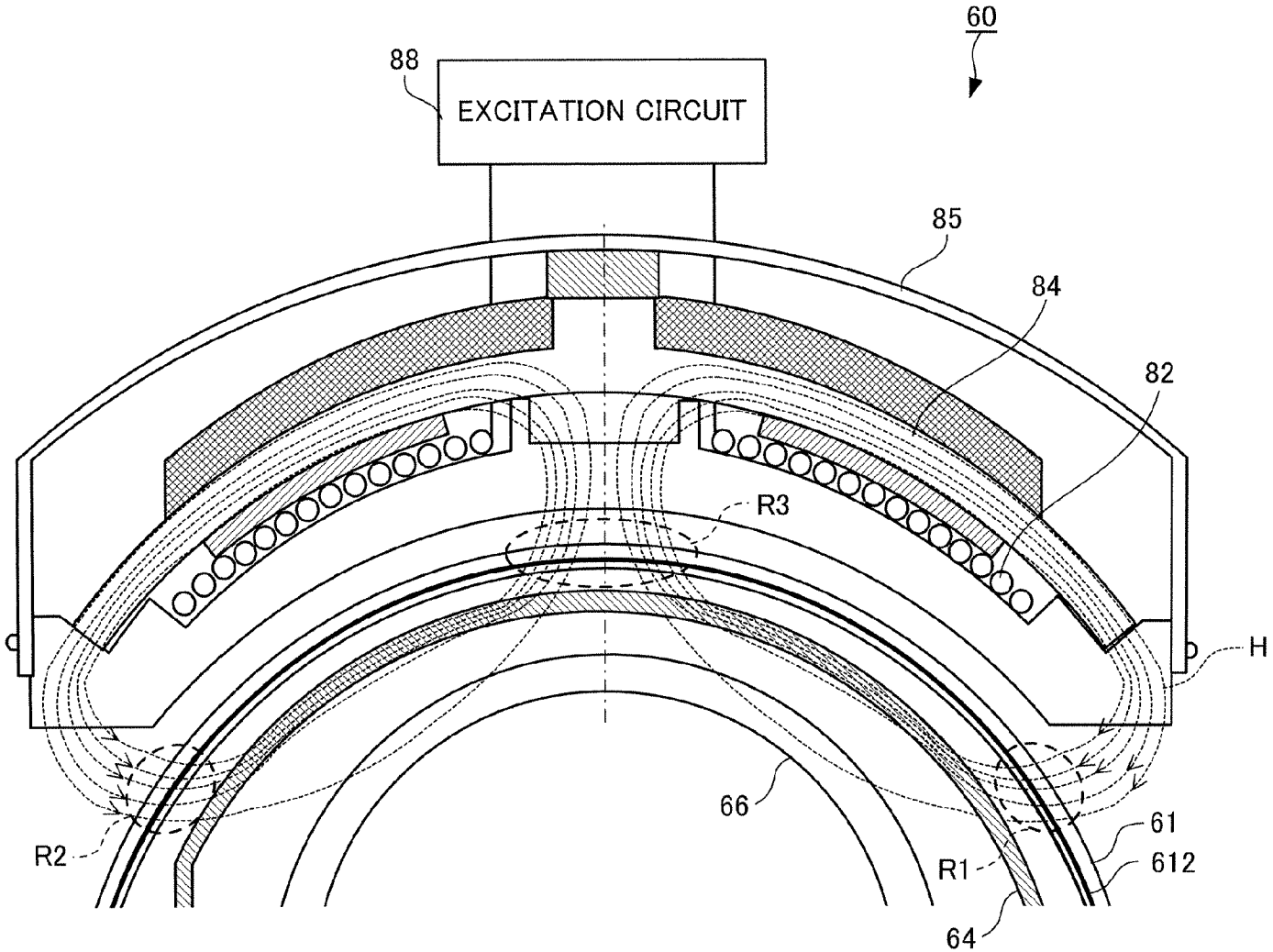
FIG. 7 is a diagram for explaining the state of the magnetic field lines H in a case where the temperature of the fixing belt is within a temperature range not greater than the permeability change start temperature.

FIG. 7 is a diagram for explaining the state of the magnetic field lines H in a case where the temperature of the fixing belt 61 is within a temperature range not greater than the permeability change start temperature. As shown in FIG. 7, in the case where the temperature of the fixing belt 61 is within a temperature range not greater than the permeability change start temperature, the magnetic field lines H of the AC magnetic field generated by the IH heater 80 form a magnetic path where the magnetic field lines H go through the fixing belt 61, and then pass through the inside of the temperature-sensitive magnetic member 64 in the spreading direction (direction orthogonal to the thickness direction). Accordingly, the number of the magnetic field lines H (density of magnetic flux) in unit area in the region where the magnetic field lines H run across the conductive heat-generating layer 612 of the fixing belt 61 becomes large.

Specifically, after the magnetic field lines H are radiated from the magnetic cores 84 of the IH heater 80 and pass through regions R1 and R2 where the magnetic field lines H run across the conductive heat-generating layer 612 of the fixing belt 61, the magnetic field lines H are induced to the inside of the temperature-sensitive magnetic member 64, which is a ferromagnetic member. For this reason, the magnetic field lines H running across the conductive heat-generating layer 612 of the fixing belt 61 in the thickness direction are concentrated so as to enter the inside of the temperature-sensitive magnetic member 64. Accordingly, the magnetic flux density becomes high in the regions R1 and R2. In addition, in a case where the magnetic field lines H passing through the inside of the temperature-sensitive magnetic member 64 along the spreading direction return to the magnetic core 84, in a region R3 where the magnetic field lines H run across the conductive heat-generating layer 612 in the thickness direction, the magnetic field lines H are generated toward the magnetic cores 84 in a concentrated manner from a portion, where the magnetic potential is low, of the temperature-sensitive magnetic member 64. For this reason, the magnetic field lines H running across the conductive heat-generating layer 612 of the fixing belt 61 in the thickness direction move from the temperature-sensitive magnetic member 64 toward the magnetic core 84 in a concentrated manner, so that the magnetic flux density in the region R3 becomes high as well.

In the conductive heat-generating layer 612 of the fixing belt 61 which the magnetic field lines H run across in the thickness direction, the eddy current I proportional to the amount of change in the number of the magnetic field lines H in unit area (magnetic flux density) is generated. Thereby, as shown in FIG. 7, a larger eddy current I is generated in the regions R1, R2 and R3 where a large amount of change in the magnetic flux density occurs. The eddy current I generated in the conductive heat-generating layer 612 generates a Joule heat W ($W=I^2R$), which is multiplication of the specific resistant value R and the square of the eddy current I of the conductive heat-generating layer 612. Accordingly, a large Joule heat W is generated in the conductive heat-generating layer 612 where the larger eddy current I is generated.

As described above, in a case where the temperature of the fixing belt 61 is within a temperature range not greater than the permeability change start temperature, a large amount of heat is generated in the regions R1, R2 and R3 where the magnetic field lines H run across the conductive heat-generating layer 612, and thereby the fixing belt 61 is heated.

Incidentally, in the fixing unit 60 of the first exemplary embodiment, the temperature-sensitive magnetic member 64 is arranged at the inner circumferential surface side of the fixing belt 61 while arranged to be close to the fixing belt 61, thereby, providing the configuration in which the magnetic core 84 inducing the magnetic field lines H generated at the excitation coil 82 to the inside thereof, and the temperature-sensitive magnetic member 64 inducing the magnetic field lines H running across and going through the fixing belt 61 in the thickness direction are arranged to be close to each other. For this reason, the AC magnetic field generated by the IH heater 80 (excitation coil 82) forms a loop of a short magnetic path, so that the magnetic flux density and the degree of magnetic coupling in the magnetic path increase. Thereby, heat is more efficiently generated in the fixing belt 61 in a case where the temperature of the fixing belt 61 is within a temperature range not greater than the permeability change start temperature.

<Description of Function for Suppressing Increase in Temperature of Non-Sheet Passing Portion of Fixing Belt>

Next, a description will be given of a function for suppressing an increase in the temperature of a non-sheet passing portion of the fixing belt 61.

Figure 8:
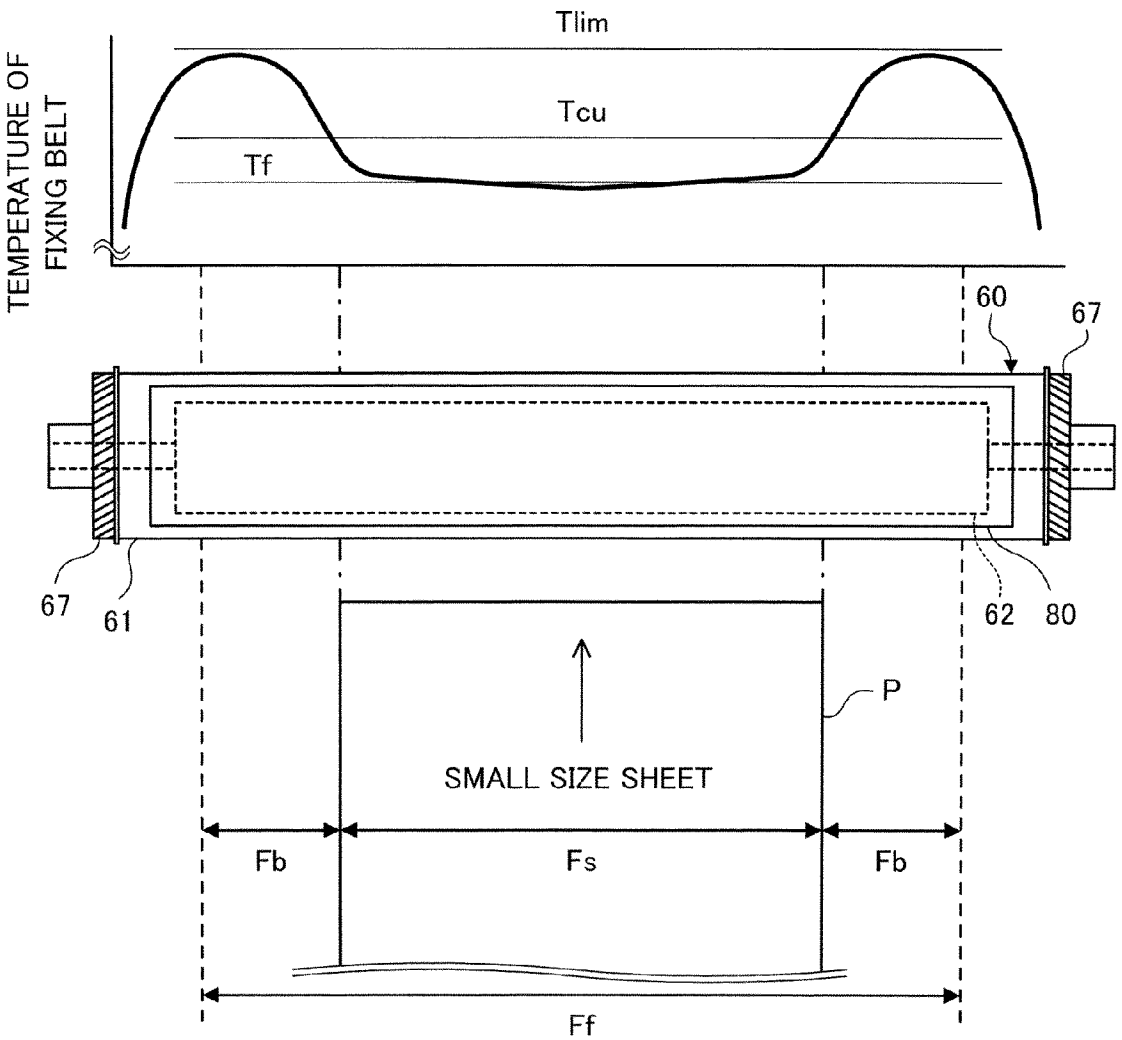
FIG. 8 is a diagram showing a summary of a temperature distribution in the width direction of the fixing belt when the small size sheets are successively inserted into the fixing unit.

Firstly, a description will be given herein of a case where sheets P of a small size (small size sheets P1) are successively inserted into the fixing unit 60. FIG. 8 is a diagram showing a summary of a temperature distribution in the width direction of the fixing belt 61 when the small size sheets P1 are successively inserted into the fixing unit 60. In FIG. 8, Ff denotes a maximum sheet passing region, which is the width (A3 long side, for example) of the maximum size of a sheet P used in the image forming apparatus 1, Fs denotes a region through which the small size sheet P1 (A4 longitudinal feed, for example) having a smaller horizontal width than that of a maximum size sheet P passes, and Fb denotes a non-sheet passing region through which no small size sheet P1 passes. Note that, sheets are inserted into the image forming apparatus 1 with the center position thereof as the reference point.

As shown in FIG. 8, when the small size sheets P1 are successively inserted into the fixing unit 60, the heat for fixing is consumed at the small size sheet passing region Fs where each of the small size sheets P1 passes. For this reason, the controller 31 (refer to FIG. 1) performs a temperature adjustment control with a fixation setting temperature, so that the temperature of the fixing belt 61 at the small size sheet passing region Fs is maintained within a range near the fixation setting temperature. Meanwhile, at the non-sheet passing regions Fb as well, the same temperature adjustment control as that performed for the small size sheet passing region Fs is performed. However, the heat for fixing is not consumed at the non-sheet passing regions Fb. For this reason, the temperature of the non-sheet passing regions Fb easily increases to a temperature higher than the fixation setting temperature. Then, when the small size sheets P1 are successively inserted into the fixing unit 60 in this state, the temperature of the non-sheet passing regions Fb increases to a temperature higher than the heat-resistant temperature of the elastic layer 613 or the surface release layer 614 of the fixing belt 61, hence deteriorating the fixing belt 61 in some cases.

In this respect, as described above, in the fixing unit 60 of the first exemplary embodiment, the temperature-sensitive magnetic member 64 is formed of, for example, a Fe—Ni alloy or the like whose permeability change start temperature is set within a temperature range not less than the fixation setting temperature and not greater than the heat-resistant temperature of the elastic layer 613 or the surface release layer 614 of the fixing belt 61. Specifically, as shown in FIG. 8, a permeability change start temperature Tcu of the temperature-sensitive magnetic member 64 is set within a temperature range not less than a fixation setting temperature Tf and not greater than a heat-resistant temperature Tlim of, for example, the elastic layer 613 or the surface release layer 614 of the fixing belt 61.

Thus, when the small size sheets P1 are successively inserted into the fixing unit 60, the temperature of the non-sheet passing regions Fb of the fixing belt 61 exceeds the permeability change start temperature of the temperature-sensitive magnetic member 64. Accordingly, the temperature of the temperature-sensitive magnetic member 64 near the fixing belt 61 at the non-sheet passing regions Fb also exceeds the permeability change start temperature in response to the temperature of the fixing belt 61 as in the case of the fixing belt 61. For this reason, the relative permeability of the temperature-sensitive magnetic member 64 at the non-sheet passing regions Fb becomes close to 1, so that the temperature-sensitive magnetic member 64 at the non-sheet passing regions Fb loses ferromagnetic properties. Since the relative permeability of the temperature-sensitive magnetic member 64 decreases and becomes closer to 1, the magnetic field lines H at the non-sheet passing regions Fb are no longer induced to the inside of the temperature-sensitive magnetic member 64, and start going through the temperature-sensitive magnetic member 64. For this reason, in the fixing belt 61 at the non-sheet passing regions Fb, the magnetic field lines H spread after passing through the conductive heat-generating layer 612, hence leading to a decrease in the density of magnetic flux of the magnetic field lines H running across the conductive heat-generating layer 612. Thereby, the amount of an eddy current I generated at the conductive heat-generating layer 612 decreases, and then, the amount of heat (Joule heat W) generated at the fixing belt 61 decreases. As a result, an excessive increase in the temperature at the non-sheet passing regions Fb is suppressed, and the fixing belt 61 is prevented from being damaged.

As described above, the temperature-sensitive magnetic member 64 functions as a detector that detects the temperature of the fixing belt 61 and also functions as a temperature increase controller that suppresses an excessive increase in the temperature of the fixing belt 61 in accordance with the detected temperature of the fixing belt 61, at a time.

The magnetic field lines H passing through the temperature-sensitive magnetic member 64 arrive at the induction member 66 (refer to FIG. 3) and then are induced to the inside thereof. When the magnetic flux arrives at the induction member 66 and then is induced to the inside thereof, a large amount of the eddy current I flows into the induction member 66, into which the eddy current I flows more easily than into the heat conducive layer 612. Thus, the amount of eddy current flowing into the conductive layer 612 is further suppressed, so that an increase in the temperature at the non-sheet passing regions Fb is suppressed.

At this time, the thickness, material and shape of the induction member 66 are selected in order that the induction member 66 may induce most of the magnetic field lines H from the excitation coil 82 and the magnetic field lines H may be prevented from leaking from the fixing unit 60. Specifically, the induction member 66 is formed of a material having a sufficiently large thickness of the skin depth δ. Thereby, even when the eddy current I flows into the induction member 66, the amount of heat to be generated is extremely small. In the first exemplary embodiment, the induction member 66 is formed of Al (aluminum), with a thickness of 1 mm, of a substantially circular arc shape along the temperature-sensitive magnetic member 64. The induction member 66 is also arranged so as not to be in contact with the temperature-sensitive magnetic member 64 (average distance therebetween is 4 mm, for example). As another example of the material, Ag or Cu may be particularly used.

Incidentally, when the temperature of the fixing belt 61 at the non-sheet passing regions Fb becomes lower than the permeability change start temperature of the temperature-sensitive magnetic member 64, the temperature of the temperature-sensitive magnetic member 64 at the non-sheet passing regions Fb also becomes lower than the permeability change start temperature thereof. For this reason, the temperature-sensitive magnetic member 64 becomes ferromagnetic again, and the magnetic field lines H are induced to the inside of the temperature-sensitive magnetic member 64. Thus, a large amount of the eddy current I flows into the conductive heat-generating layer 612. For this reason, the fixing belt 61 is again heated.

Figure 9:
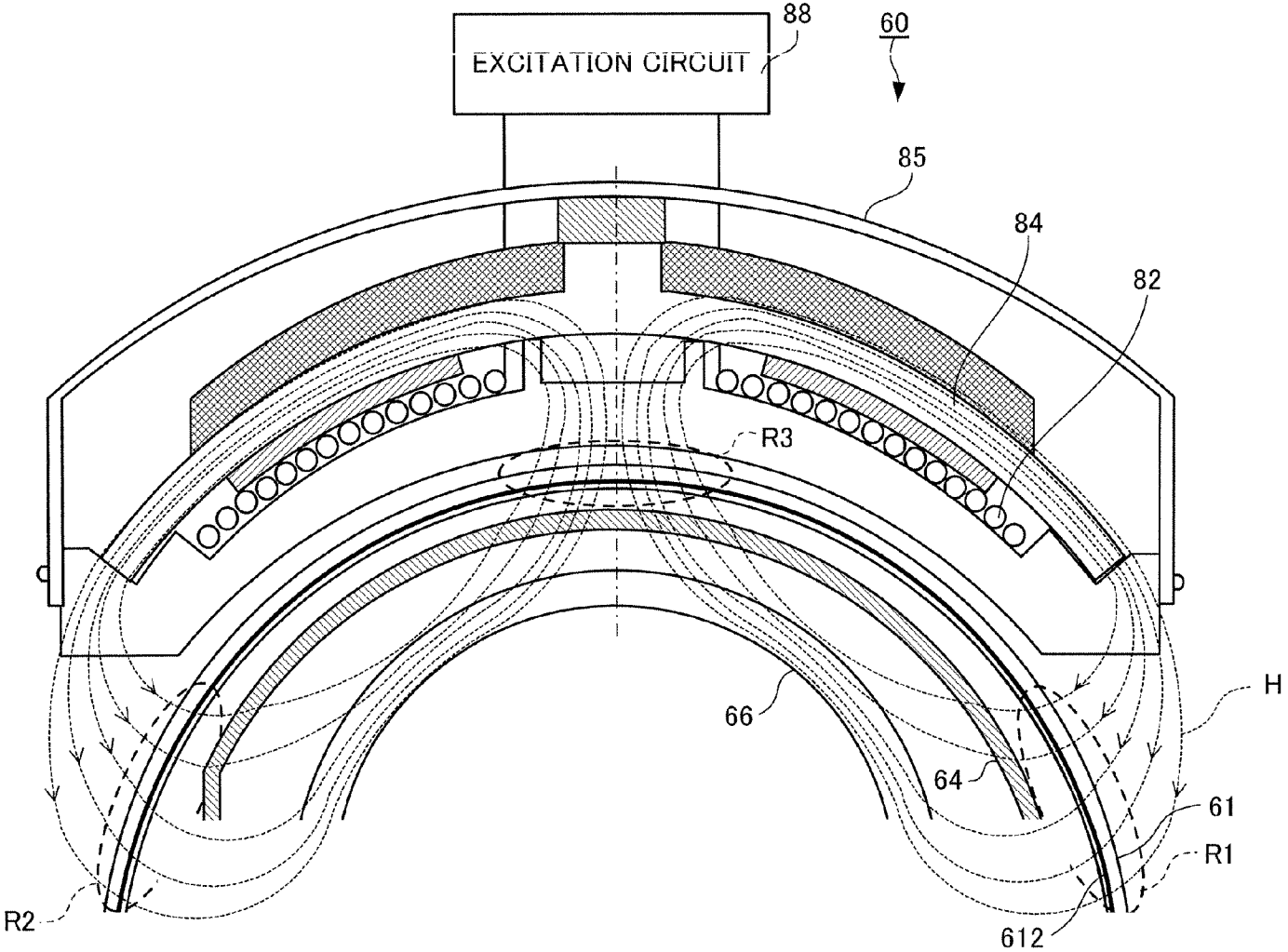
FIG. 9 is a diagram for explaining a state of the magnetic field lines when the temperature of the fixing belt at the non-sheet passing regions is within a temperature range exceeding the permeability change start temperature.

FIG. 9 is a diagram for explaining a state of the magnetic field lines H when the temperature of the fixing belt 61 at the non-sheet passing regions Fb is within a temperature range exceeding the permeability change start temperature. As shown in FIG. 9, when the temperature of the fixing belt 61 at the non-sheet passing regions Fb is within the temperature range exceeding the permeability change start temperature, the relative permeability of the temperature-sensitive magnetic member 64 at the non-sheet passing regions Fb decreases. For this reason, the magnetic field lines H of the AC current generated by the IH heater 80 changes so as to easily go through the temperature-sensitive magnetic member 64. Thereby, the magnetic field lines H of the AC current generated by the IH heater 80 (excitation coil 82) are radiated from the magnetic cores 84 so as to spread toward the fixing belt 61 and arrive at the induction member 66.

Specifically, at the regions R1 and R2 where the magnetic field lines H are radiated from the magnetic cores 84 of the IH heater 80 and then run across the conductive heat-generating layer 612 of the fixing belt 61, since the magnetic field lines H are not easily induced to the temperature-sensitive magnetic member 64, the magnetic field lines H radially spread. Accordingly, the density of the magnetic flux (the number of the magnetic field lines H per unit area) of the magnetic field lines H running across the conductive heat-generating layer 612 of the fixing belt 61 in the thickness direction decreases. In addition, at the region R3 where the magnetic field lines H run across the conductive heat-generating layer 612 in the thickness direction when returning to the magnetic cores 84 again, the magnetic field lines H return to the magnetic cores 84 from the wide region where the magnetic field lines H spread, so that the density of the magnetic flux of the magnetic field lines H running across the conductive heat-generating layer 612 of the fixing belt 61 in the thickness direction decreases.

For this reason, when the temperature of the fixing belt 61 is within the temperature range exceeding the permeability change start temperature, the density of the magnetic flux of the magnetic field lines H running across the conductive heat-generating layer 612 in the thickness direction at the regions R1, R2 and R3 decreases. Accordingly, the amount of the eddy current I generated in the conductive heat-generating layer 612 where the magnetic field lines H run across in the thickness direction decreases, and the Joule heat W generated at the fixing belt 61 decreases. Therefore, the temperature of the fixing belt 61 decreases.

As described above, when the temperature of the fixing belt 61 at the non-sheet passing regions Fb is within a temperature range not less than the permeability change start temperature, the magnetic field lines H are not easily induced to the inside of the temperature-sensitive magnetic member 64 at the non-sheet passing regions Fb. Thus, the magnetic field lines H of the AC magnetic field generated by the excitation coil 82 spread and run across the conductive heat-generating layer 612 of the fixing belt 61 in the thickness direction. Accordingly, the magnetic path of the AC magnetic field generated by the excitation coil 82 forms a long loop, so that the density of magnetic flux in the magnetic path in which the magnetic field lines H pass through the conductive heat-generating layer 612 of the fixing belt 61 decreases.

Thereby, at the non-sheet passing regions Fb where the temperature thereof increases, for example, when the small size sheets P1 are successively inserted into the fixing unit 60, the amount of the eddy current I generated at the conductive heat-generating layer 612 of the fixing belt 61 decreases, and the amount of heat (Joule heat W) generated at the non-sheet passing regions Fb of the fixing belt 61 decreases. As a result, an excessive increase in the temperature of the non-sheet passing regions Fb is suppressed.

<Description of Configuration for Suppressing Increase in Temperature of Temperature-Sensitive Magnetic Member>

In order for the temperature-sensitive magnetic member 64 to satisfy the aforementioned function to suppress an excessive increase in the temperature at the non-sheet passing regions Fb, the temperature of each region of the temperature-sensitive magnetic member 64 in the longitudinal direction needs to change in accordance with the temperature of each region of the fixing belt 61 in the longitudinal direction, which faces each region of the temperature-sensitive magnetic member 64 in the longitudinal direction, to satisfy the aforementioned function as a detector that detects the temperature of the fixing belt 61.

For this reason, as the configuration of the temperature-sensitive magnetic member 64, a configuration in which the temperature-sensitive magnetic member 64 is not easily subjected to induction heating by the magnetic field lines H is employed. Specifically, even when the temperature-sensitive magnetic member 64 is in a state of being ferromagnetic since the temperature of the fixing belt 61 is not greater than the permeability change start temperature, some of the magnetic field lines H that run across the temperature-sensitive magnetic member 64 in the thickness direction still exist in the magnetic field lines H from the IH heater 80. Thus, a weak eddy current I is generated inside the temperature-sensitive magnetic member 64, so that a small amount of heat is generated in the temperature-sensitive magnetic member 64 as well. For this reason, for example, in a case where a huge amount of image formation is successively performed, the heat generated by the temperature-sensitive magnetic member 64 is accumulated in itself, and the temperature of the temperature-sensitive magnetic member 64 at the sheet passing region (refer to FIG. 8) tends to increase. When the amount of the self-heating due to the eddy current loss in this manner is large, the temperature of the temperature-sensitive magnetic member 64 increases, and unintentionally reaches the permeability change start temperature. As a result, the magnetic characteristic difference between the sheet-passing region and the non-sheet passing regions no longer exists, and thus, the effect of suppressing a temperature increase becomes no longer effective. In this respect, in order to maintain the correspondence relationship between the respective temperatures of the temperature-sensitive magnetic member 64 and the fixing belt 61 and in order for the temperature-sensitive magnetic member 64 to function as the detector that detects the temperature of the fixing belt 61 with high accuracy, Joule heat W to be generated in the temperature-sensitive magnetic member 64 needs to be suppressed.

With this respect, firstly, a material having properties (specific resistance and permeability) not easily subjected to induction heating by the magnetic field lines H is selected as the material of the temperature-sensitive magnetic member 64.

Secondly, the thickness of the temperature-sensitive magnetic member 64 is formed to be larger than the skin depth δ in the state where the temperature-sensitive magnetic member 64 is ferromagnetic, in order that the magnetic field lines H may not easily run across the temperature-sensitive magnetic member 64 in the thickness direction when the temperature of the temperature-sensitive magnetic member 64 is at least within a temperature range not greater than the permeability change start temperature.

Thirdly, multiple slits 64*s* each dividing the flow of an eddy current I generated by the magnetic field lines H are formed in the temperature-sensitive magnetic member 64. Even when the material and the thickness of the temperature-sensitive magnetic member 64 are selected so as not to be easily subjected to induction heating, it is difficult to make the eddy current I generated inside the temperature-sensitive magnetic member 64 be zero (0). In this respect, the amount of eddy current I is decreased by dividing the flow of the eddy current I generated in the temperature-sensitive magnetic member 64 with the multiple slits 64*s*. Thereby, Joule heat W generated in the temperature-sensitive magnetic member 64 is suppressed to be low.

Figure 10A:
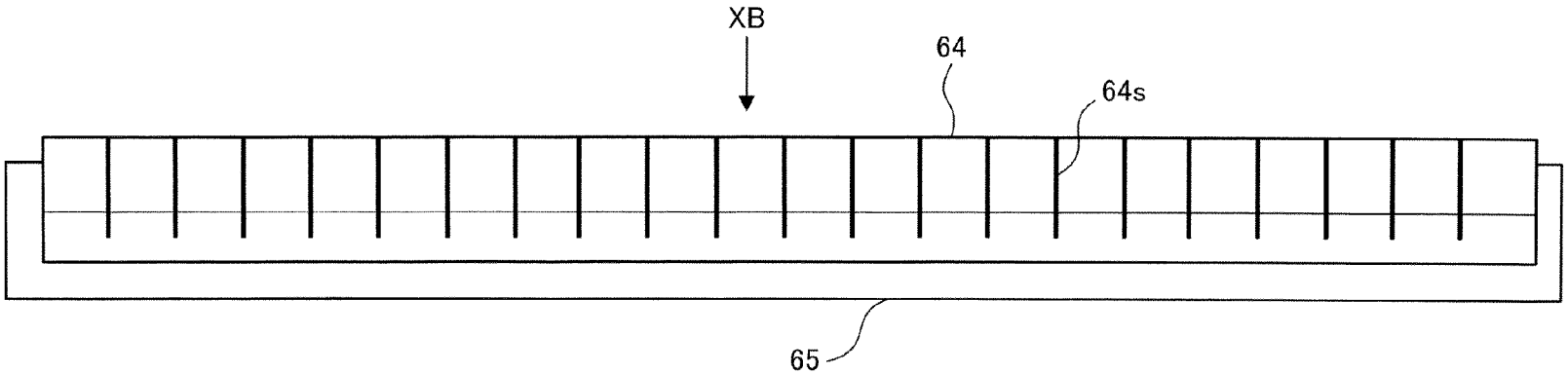
FIGS. 10A and 10B are diagrams showing slits formed in the temperature-sensitive magnetic member.
Figure 10B:
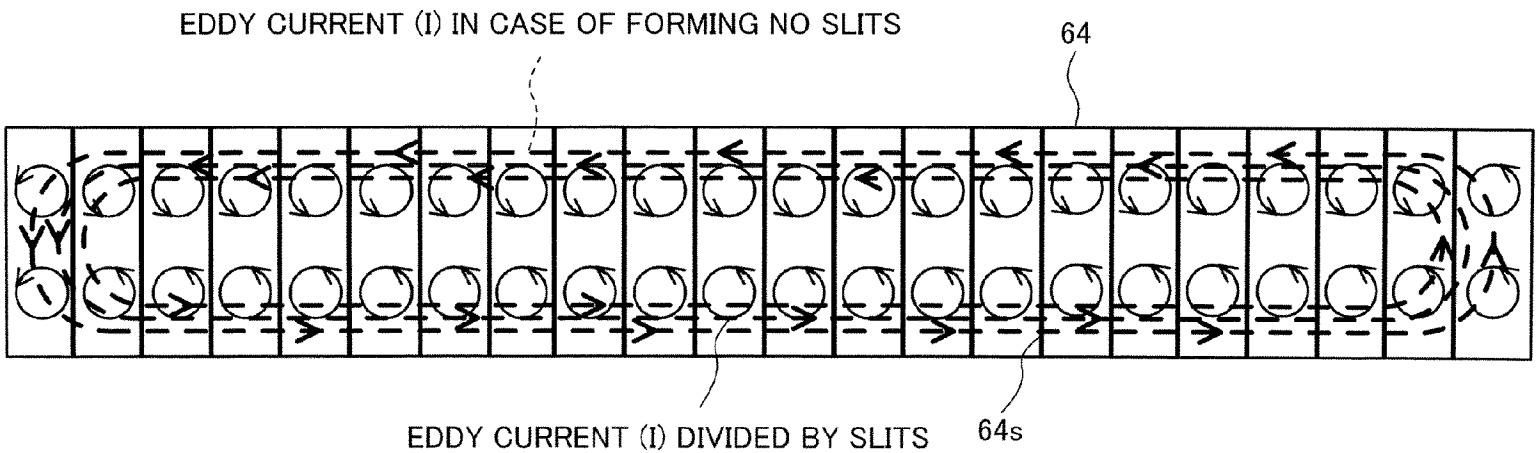

FIGS. 10A and 10B are diagrams showing slits 64*s* formed in the temperature-sensitive magnetic member 64. FIG. 10A is a side view showing a state where the temperature-sensitive magnetic member 64 is mounted on the holder 65. FIG. 10B is a plain view showing a state when FIG. 10A is viewed from above (XB direction). As shown in FIGS. 10A and 10B, the multiple slits 64*s* are formed in a direction orthogonal to the direction of the flow of the eddy current I generated by the magnetic field lines H, in the temperature-sensitive magnetic member 64. Thereby, the eddy current I (shown by broken lines in FIG. 10B), which flows in the entire temperature-sensitive magnetic member 64 in the longitudinal direction while forming a large swirl in a case of forming no slits 64*s*, is divided by the slits 64*s*. Accordingly, in a case where the slits 64*s* are formed, the eddy current I (shown by a solid line in FIG. 10A) that flows in the temperature-sensitive magnetic member 64 becomes small swirls each being in a region formed between adjacent two of the slits 64*s*, hence reducing the entire amount of the eddy current I. As a result, the amount of heat (Joule heat W) generated in the temperature-sensitive magnetic member 64 decreases. Thereby, the configuration in which heat is not easily generated is achieved. Accordingly, each of the multiple slits 64*s* functions as an eddy current dividing unit that divides the eddy current I.

Note that, the slits 64*s* are formed in the direction orthogonal to the direction of the flow of the eddy current I in the temperature-sensitive magnetic member 64 exemplified in FIGS. 10A and 10B. However, as long as the configuration allows the slits 64*s* to divide the flow of the eddy current I, slits inclined with respect to the direction of the flow of the eddy current I may be formed, for example. Moreover, other than the configuration as shown in FIGS. 10A and 10B in which the slits 64*s* are formed over the entire region in the width direction of the temperature-sensitive magnetic member 64, slits may be partially formed in the width direction of the temperature-sensitive magnetic member 64. Furthermore, the number of, the position of or the inclination angle of slits 64*s* may be configured in accordance with the amount of heat to be generated in the temperature-sensitive magnetic member 64.

In addition, slits 64*s* may be formed in the temperature-sensitive magnetic member 64 in a way that the temperature-sensitive magnetic member 64 is divided into a group of small pieces by the slits 64*s* with an inclination angle of each slit 64*s* being the maximum. The effects of the present invention may be obtained in this configuration as well.

<Description of Method of Securing Excitation Coil and Magnetic Cores in IH Heater>

Next, with reference back to FIG. 6, a description will be given of a method of securing, onto the support member 81, the excitation coil 82 and the magnetic cores 84 in the IH heater 80 of the first exemplary embodiment.

As shown in FIG. 6, in the IH heater 80 of the first exemplary embodiment, the excitation coil 82 is provided between the magnetic cores 84 and the support member 81 and is pressed against the supporting surface 81*a* of the support member 81 by the sheet-like elastic support members 83. Thereby, the excitation coil 82 is secured so as to be in close contact with the supporting surface 81*a*. Here, each of the sheet-like elastic support members 83 is formed into a sheet-like shape continuous in the axis direction of the fixing belt 61 as will be described later, and is arranged to be in contact with the multiple magnetic cores 84. Specifically, the sheet-like elastic support member 83 is formed of a sheet-like elastic material having a low Young's modulus such as a silicone rubber and a fluorine rubber, for example. The sheet-like elastic support member 83 is then arranged so as to press the excitation coil 82 against the supporting surface 81*a* of the support member 81. Thereby, the sheet-like elastic support member 83 secures the excitation coil 82 while causing the excitation coil 82 to be in close contact with the supporting surface 81*a*. Here, in this case, the supporting surface 81*a* is formed and designed to keep a gap set in advance (design value) with the surface of the fixing belt 61. For this reason, the excitation coil 82 is set so as to keep a gap set in advance between the entire excitation coil 82 and the surface of the fixing belt 61.

Moreover, each of the multiple magnetic cores 84 arranged in the width direction of the fixing belt 61 has an inner circumferential surface on the excitation coil 82 side formed into a circular arc shape (inner circumferential side circular arc surface) in the moving direction of the fixing belt 61. In addition, the inner circumferential side circular arc surface (denoted by a later described reference numeral 84*b* in FIG. 11) of the magnetic core 84 is formed so as to cover (wrap) an entire region on which the excitation coil 82 is arranged, in the moving direction of the fixing belt 61. The inner circumferential side circular arc surface 84*b* of each of the magnetic cores 84 is supported by a pair of magnetic core supporting units 81*b*1 and 81*b*2 (refer to later described FIG. 11) arranged in parallel along the center axis in the longitudinal direction on the supporting surface 81*a*, and thereby, a gap between the magnetic core 84 and the supporting surface 81*a* is set to be kept constant. At this time, the magnetic core 84 is movably supported in the moving direction of the fixing belt 61 between magnetic core regulation units 81*c* (as a second support member) respectively arranged at both side portions of the supporting surface 81*a* in the moving direction of the fixing belt 61.

The inner circumferential side circular arc surfaces 84*b* of the magnetic cores 84 are supported by the pair of the magnetic core supporting units 81*b*1 and 81*b*2, and then, each of the magnetic cores 84 is pressed toward the support member 81 from the top surface thereof, via a corresponding one of the magnetic holders 87, by the sponge-like pressing member 86 provided at the bottom surface of the shield 85. Each of the magnetic cores 84 is pressed so as to be held between the pressing member 86 at the top surface thereof and the sheet-like elastic materials 83 at the bottom surface thereof, thereby, being secured within the IH heater 80.

Figure 11:
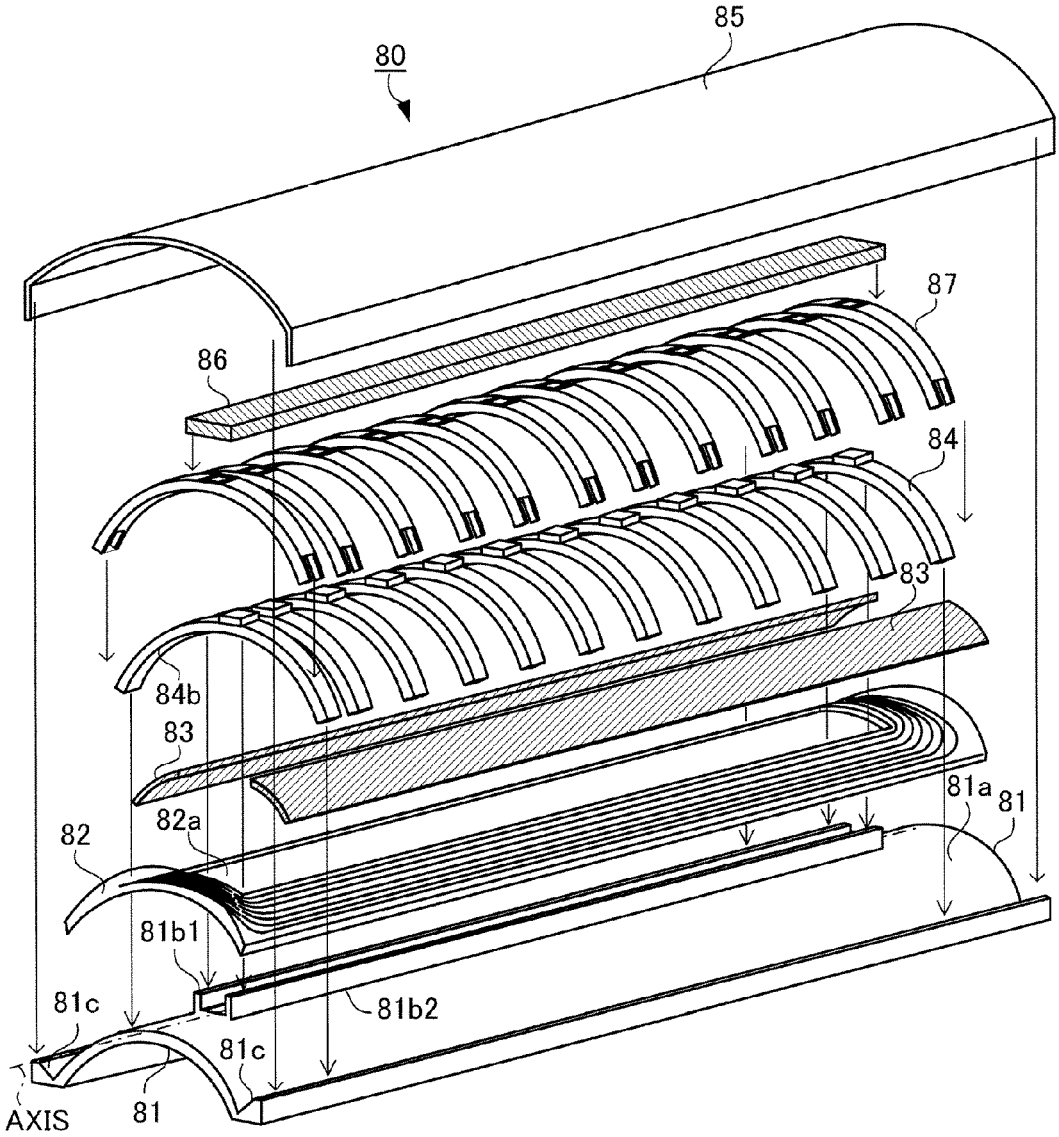
FIG. 11 is a diagram for explaining a multi-layer structure of the IH heater.

FIG. 11 is a diagram for explaining a multi-layer structure of the IH heater 80 in the first exemplary embodiment. As shown in FIG. 11, the excitation coil 82 is mounted on the supporting surface 81*a* of the support member 81 so that a closed loop hollow portion 82*a* of the excitation coil 82 surrounds the pair of the magnetic core supporting units (convex portions) 81*b*1 and 81*b*2 as an example of a position setting unit arranged in parallel along the center axis in the longitudinal direction of the supporting surface 81*a*. The supporting surface 81*a* is formed as a position setting surface whose gap with the fixing belt 61 that rotationally moves in a substantially circular orbit is set at a defined value (design value). Thereby, when the excitation coil 82 is arranged so as to be in close contact with the supporting surface 81*a*, the gap between the excitation coil 82 and the fixing belt 61 is set at the design value.

For this reason, in the IH heater 80 of the first exemplary embodiment, the excitation coil 82 arranged on the supporting surface 81*a* of the support member 81 is configured to be pressed against the supporting surface 81*a* by the sheet-like elastic support members 83 formed in the longitudinal direction of the support member 81.

Specifically, when the magnetic cores 84 are arranged on top of the excitation coil 82, the inner circumferential side circular arc surfaces 84*b* of the magnetic cores 84 are supported by the pair of the magnetic core supporting units 81*b*1 and 81*b*2 provided on the supporting surface 81*a*. Thereby, the gap between each of the magnetic cores 84 and the supporting surface 81*a* is set at a predetermined gap set in advance. In this case, the thickness of each of the sheet-like elastic support members 83 arranged between the magnetic cores 84 and the excitation coil 82 is formed to be larger than the gap between each of the magnetic cores 84 and the supporting surface 81*a* when the inner circumferential side circular arc surfaces 84*b* are supported by the magnetic core supporting units 81*b*1 and 81*b*2.

In addition, when the shield 85 is attached onto the support member 81, the magnetic cores 84 are pressed against the support member 81 by the pressing member 86 provided at the bottom surface side of the shield 85. Thereby, the sheet-like elastic support members 83 receive pressing force toward the support member 81 side from the pressing member 86 via the magnetic holders 87 and the magnetic cores 84, and then are elastically deformed (compressed). The elastically deformed sheet-like elastic members 83 press the excitation coil 82 against the supporting surface 81*a* by the elastic force generated therefrom. The excitation coil 82 is then brought into close contact with the supporting surface 81*a* and secured thereto. Since the supporting surface 81*a* is formed and set so as to keep a gap set in advance (design value) with the surface of the fixing belt 61, the distance between the excitation coil 82 and the fixing belt 61 is set at a design value.

Here, in the first exemplary embodiment, the pressing force of the pressing member 86 may be greater than the elastic force generated by each of the sheet-like elastic support members 83. Thereby, the positioning by the securement of the magnetic cores 84 and the excitation coil 82 may be securely performed. Note that, in addition to an elastic material such as a silicone rubber or a fluorine rubber, an elastic member such as a spring may be used as the pressing member 86.

In general, when the AC magnetic field is generated by the excitation coil 82, magnetic force is mutually brought into effect between each of the magnetic cores 84 arranged near the excitation coil 82 and the temperature-sensitive magnetic member 64 or the like arranged at the inner circumferential surface side of the fixing belt 61, and thereby, vibration (magnetostriction) occurs in the excitation coil 82. For this reason, when the excitation coil 82 is secured to the support member 81 by use of a so-called rigid material (material having a high Young's modulus) such as an adhesive, peeling tend to occur between the rigid material such as an adhesive for securing the excitation coil 82 and the excitation coil 82 due to the vibration of the excitation coil 82, the vibration occurring in accumulated use for a long period of time. When the excitation coil 82 peels from the adhesive or the like, the position of the excitation coil 82 on the supporting surface 81*a* is shifted, or the excitation coil 82 deforms. In this case, the distance between the excitation coil 82 and the fixing belt 61 deviates from the originally designed value, and the density (density of magnetic flux) of the magnetic field lines passing through the magnetic cores 84 and then through the fixing belt 61 partially varies on the surface of the fixing belt 61. As a result, the amount of an eddy current I generated on the fixing belt 61 becomes nonuniform, and the amount of heat generated on the surface of the fixing belt 61 varies in the longitudinal direction, thereby causing unevenness in fixation.

In addition, in a case where the excitation coil 82 is secured onto the support member 81 with use of the rigid material such as an adhesive, the entire surface of the excitation coil 82 needs to be secured until the adhesive or the like becomes solidified in order to avoid displacement between the excitation coil 82 and the support member 81. However, since the excitation coil 82 is obtained by bundling and adhering litz wires in a closed loop shape, the excitation coil 82 easily deforms. For this reason, deformation or displacement of the excitation coil 82 may occur before the adhesive or the like is solidified, hence, reducing the positional accuracy of the excitation coil 82 with respect to the support member 81 in some cases. When the positional accuracy of the excitation coil 82 with respect to the support member 81 reduces, the amount of heat generated on the surface of the fixing belt 61 partially varies as in the above case.

In this respect, in the IH heater 80 of the first exemplary embodiment employs the following configuration. The pressing member 86 is provided at the bottom surface of the shield 85, and the sheet-like elastic support members 83 each formed into a sheet-like shape in the longitudinal direction of the support member 81 are arranged between the magnetic cores 84 and the excitation coil 82. Further, the shield 85 is attached onto the support member 81. Thereby, the pressing member 86 and the sheet-like elastic support members 83 are pressed against the support member 81. The pressing member 86 then receives pressing force toward the support member 81, and is elastically deformed (compressed). Each of the sheet-like elastic support members 83 also receives pressing force toward the support member 81 from the pressing member 86 via the magnetic holders 87 and the magnetic cores 84, and is elastically deformed (compressed). Then, with the elastic force generated at this time, the sheet-like elastic support members 83 support the excitation coil 82 so as to be in close contact with the supporting surface 81*a* by pressing the excitation coil 82 against the support member 81. The sheet-like elastic support members 83 each formed of a rubber elastic material elastically deform in accordance with the vibration of the excitation coil 82 while absorbing the vibration of the excitation coil 82. For this reason, even when the number of accumulations of the vibration of the excitation coil 82 grows larger because of the accumulated use of the fixing unit 60 for a long period of time, peeling does not occur between the sheet-like elastic support members 83 and the excitation coil 82, and the positional relationship, set by default, between the support member 81 and the excitation coil 82 is maintained.

In addition, the thickness (set value) of each of the pressing member 86 and the sheet-like elastic support members 83 is manageable to be within a certain dimensional accuracy at the time of manufacturing. For this reason, it is easy to set the pressing force for supporting the magnetic cores 84 and the excitation coil 82 on the supporting surface 81*a* to be substantially uniform in the longitudinal direction or the like. Moreover, in the IH heater 80 of the first exemplary embodiment, the multiple magnetic cores 84 provided at separate regions, respectively, in the longitudinal direction of the excitation coil 82 uniformly press the sheet-like elastic support members 83 in the longitudinal direction. Accordingly, the adhesiveness between the excitation coil 82 and the supporting surface 81*a* is enhanced in the longitudinal direction.

In addition to the above, at the time of manufacturing the IH hear 80, the excitation coil 82 is attached in a short period of time since a period of time for solidifying the adhesive is not necessary.

In general, ferrite constituting each of the magnetic cores 84 is a material whose shape easily varies by heat processing performed after molding, and thus, it is difficult to improve the dimensional accuracy of a component made of ferrite. For this reason, when the positions of the magnetic cores 84 and the excitation coil 82 are to be set on the basis of the shape of the magnetic cores 84 that have been molded and subjected to the heat processing, the positional accuracy between these components decreases. The AC magnetic field outputted from the IH heater 80 is then largely influenced by the nonuniformity occurring in the positional relationship between each of the magnetic cores 84 and the excitation coil 82. According to an experiment, if the gap between each of the magnetic cores 84 and the excitation coil 82 changes by 0.5 mm for example, the resistance and inductance of an electric circuit configured of the excitation coil 82 and the excitation circuit 88 change by approximately 10%. For this reason, when the positional accuracy between the magnetic core 84 and the excitation coil 82 decreases, distribution of magnetic field lines passing through the inside of the magnetic core 84 changes between upstream side and downstream side regions with respect to the center axis in the longitudinal direction as the center, and a partial nonuniformity occurs in the amount of heat generated on the surface of the fixing belt 61, for example.

In this case, in particular, the nonuniformity easily occurs in the curvature of the inner circumferential side circular arc surface 84*b* of the magnetic core 84. In the first exemplary embodiment, even when the nonuniformity occurs in the curvature of the inner circumferential side circular arc surface 84*b* of the magnetic core 84, the above-described support structure with the pair of the magnetic core supporting units 81*b*1 and 81*b*2 and the inner circumferential side circular arc surface 84*b* allows the gaps between the inner circumferential side circular arc surface 84*b* of the magnetic core 84 and the supporting surface 81*a* supporting the excitation coil 82, on the upstream side and down stream side regions to be substantially symmetrical with respect to the center axis in the longitudinal direction as the center.

As described above, in the fixing unit 60 included in the image forming apparatus 1 of the first exemplary embodiment, the excitation coil 82 and the magnetic cores 84 are secured by the pressing member 86 and the sheet-like elastic support members 83 each formed into a sheet-like shape in the longitudinal direction of the support member 81. Then, the excitation coil 82 and the magnetic cores 84 are positioned with respect to the support member 81 by the pressing force of the pressing member 86. In addition, the pressing force of the pressing member 86 is made to be larger than the reactive force of the sheet-like elastic support members 83, thereby, ensuring the positioning by securement.

Accordingly, as compared with a conventional case where the excitation coil 82 and the magnetic cores 84 are secured by use of an adhesive or the like, problems including a crack on the magnetic core 84 due to the peeling of the adhesive or the like, and the peeling are addressed, and displacement between the excitation coil 82 and the magnetic cores 84 which may occur due to a long-term use is prevented. Furthermore, an adhesive securing system is no longer required, resulting in a reduction in manufacturing costs.

Second Exemplary Embodiment

<Description of IH Heater>

Next, descriptions will be given of another example of the IH heater 80 included in the fixing unit 60 of the second exemplary embodiment. Note that, the same reference numerals are used to denote the same components as those of the first exemplary embodiment, and detailed descriptions thereof are omitted herein.

Figure 12:
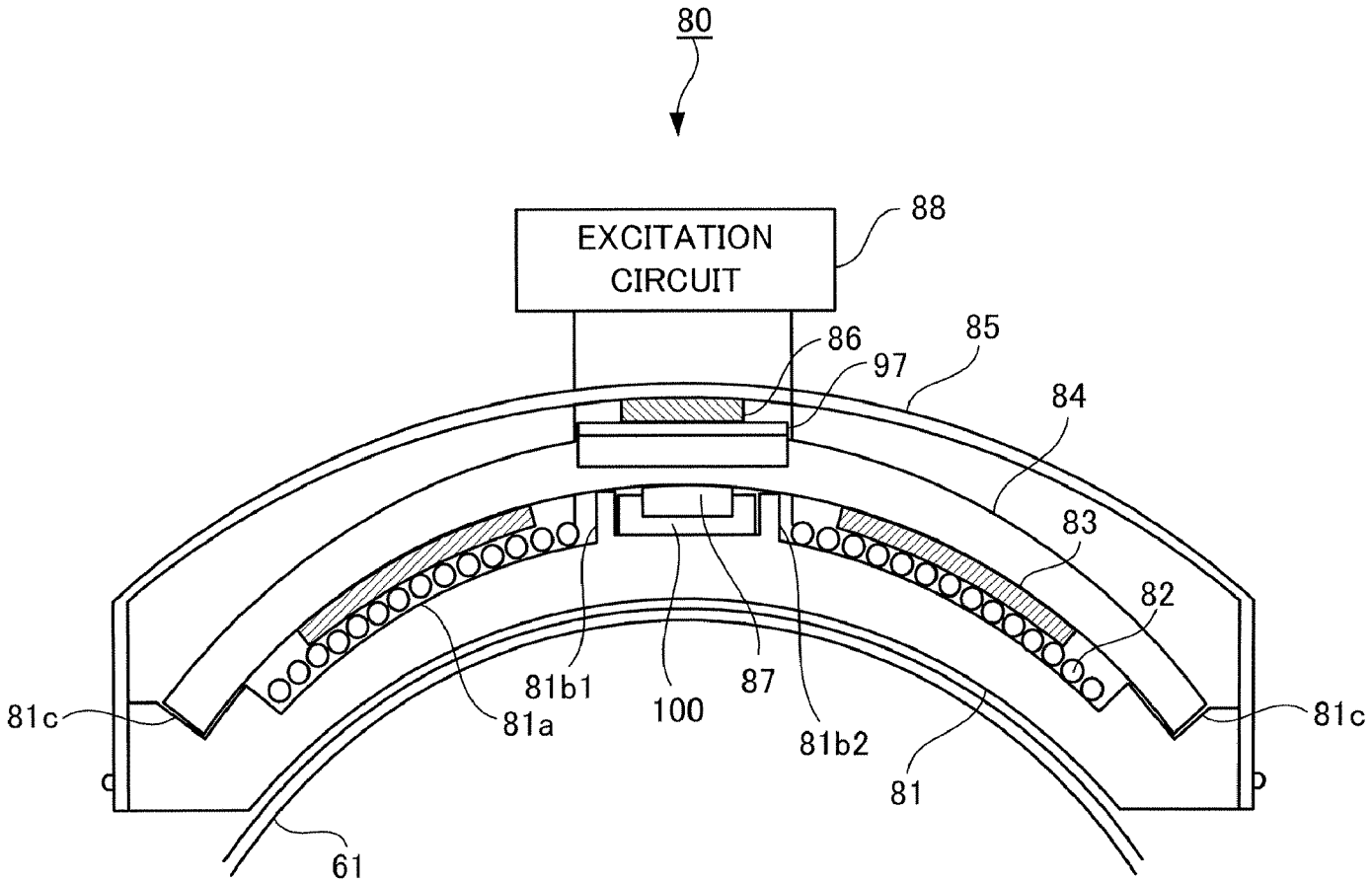
FIG. 12 is a cross sectional view for explaining a configuration of the IH heater.

FIG. 12 is a cross sectional view for explaining a configuration of the IH heater 80 of the second exemplary embodiment. As shown in FIG. 12, the IH heater 80 of the second exemplary embodiment includes: the support member 81 as an example of a support member formed of a non-magnetic material such as a heat-resistant resin or the like, for example; and the excitation coil 82 as an example of a magnetic field generating member that generates an AC magnetic field. In addition, the IH heater 80 includes: the sheet-like elastic members 83 each formed of an elastic material that secures the excitation coil 82 onto the support member 81; and the multiple magnetic cores 84 that are arranged in the width direction of the fixing belt 61 and each forming a magnetic path of the AC magnetic field generated by the excitation coil 82. The IH heater 80 further includes: adjustment magnetic cores 100 that are arranged at multiple positions in the width direction of the fixing belt 61 and that are provided as an example of a plurality of adjustment magnetic members that makes the AC magnetic field generated by the excitation coil 82 uniform in the longitudinal direction of the support member 81; and a magnetic core setting member 97 as an example of a position setting member that sets positions of the magnetic cores 84 and the adjustment magnetic cores 100 in the longitudinal direction of the support member 81. The IH heater 80 also includes: the shield 85 that shields a magnetic field; the pressing member 86 that presses the magnetic cores 84 against the support member 81; and the excitation circuit 88 as an example of a power supply source that supplies an AC current (electric power) to the excitation coil 82. Each of the sheet-like elastic support members 83 is formed into a sheet-like shape continuous in the axis direction of the fixing belt 61 so as to be arranged between the excitation coil 82 and the magnetic cores 84 and to be in contact with the multiple magnetic cores 84.

The support member 81 is formed with a cross section curved along the surface shape of the fixing belt 61 and is configured to keep a gap set in advance (0.5 mm to 5 mm, for example) between the supporting surface (top surface) 81*a* supporting the excitation coil 82 and the surface of the fixing belt 61. In addition, in the center of the supporting surface 81*a*, the pair of the magnetic core supporting units (convex portions) 81*b*1 and 81*b*2 that support the magnetic cores 84 are arranged in parallel along the longitudinal direction. The magnetic core supporting units 81*b*1 and 81*b*2 support the magnetic cores 84 so as to keep the gap between each of the magnetic cores 84 and the supporting surface 81*a* constant. In addition, a space at which the adjustment magnetic cores 100 are arranged is formed at an inner region between the magnetic core supporting units 81*b*1 and 81*b*2.

Moreover, the magnetic core regulation units 81*c* that regulate movement of the magnetic cores 84 supported by the magnetic core supporting units 81*b*1 and 81*b*2 in the moving direction (circular arc direction) of the fixing belt 61 are arranged respectively at both side portions of the supporting surface 81*a*.

As the material that forms the support member 81, a heat-resistant non-magnetic material such as a heat-resistant glass, a heat-resistant resin including polycarbonate, polyethersulphone or PPS (polyphenylenesulfide), or the aforementioned heat-resistant resin containing a glass fiber therein is used, for example.

The excitation coil 82 is formed by winding a litz wire in a closed loop of an oval shape, elliptical shape or rectangular shape having an opening inside, the litz wire being obtained by bundling 90 pieces of mutually isolated copper wires each having a diameter of 0.17 mm, for example. Then, when an AC current having a frequency set in advance is supplied from the excitation circuit 88 to the excitation coil 82, an AC magnetic field on the litz wire wound in a closed loop shape as the center is generated around the excitation coil 82. In general, a frequency of 20 kHz to 100 kHz, which is generated by the aforementioned general-purpose power supply, is used for the frequency of the AC current supplied to the excitation coil 82 from the excitation circuit 88.

As the material of each of the magnetic cores 84, a ferromagnetic material that is formed into a circular arc shape, and that is formed of an oxide or alloy material with a high permeability, such as a calcined ferrite, a ferrite resin, a non-crystalline alloy (amorphous alloy), permalloy or a temperature-sensitive magnetic alloy is used. The magnetic core 84 functions as a plurality of magnetic path forming members. The magnetic core 84 induces, to the inside thereof, the magnetic field lines (magnetic flux) of the AC magnetic field generated at the excitation coil 82, and forms a path (magnetic path) of the magnetic field lines in which the magnetic field lines from the magnetic core 84 run across the fixing belt 61 to be directed to the temperature-sensitive magnetic member 64, then pass through the inside of the temperature-sensitive magnetic member 64, and return to the magnetic core 84. Specifically, a configuration in which the AC magnetic field generated at the excitation coil 82 passes through the inside of the magnetic core 84 and the inside of the temperature-sensitive magnetic member 64 is employed, and thereby, a closed magnetic path where the magnetic field lines internally wrap the fixing belt 61 and the excitation coil 82 is formed. Thereby, the magnetic field lines of the AC magnetic field generated at the excitation coil 82 are concentrated at a region of the fixing belt 61, which faces the magnetic core 84.

Here, the material of the magnetic core 84 may be one that has a small amount of loss due to the forming of the magnetic path. Specifically, the magnetic core 84 may be particularly used in a form that reduces the amount of eddy-current loss (shielding or dividing of the electric current path by having a slit or the like, or bundling of thin plates, or the like). In addition, the magnetic core 84 may be particularly formed of a material having a small hysteresis loss.

The length of the magnetic core 84 along the rotation direction of the fixing belt 61 is formed so as to be shorter than the length of the temperature-sensitive magnetic member 64 along the rotation direction of the fixing belt 61. Thereby, the amount of leakage of the magnetic field lines toward the periphery of the IH heater 80 is reduced, resulting in improvement in the power factor. Moreover, the electromagnetic induction toward the metal materials forming the fixing unit 60 is also suppressed and the heat-generating efficiency at the fixing belt 61 (conductive heat-generating layer 612) increases.

The magnetic cores 84 are supported by the pair of the magnetic core supporting units (convex portions) 81*b*1 and 81*b*2 that are arranged at the center of the supporting surface 81*a*, and the positions of the magnetic cores 84 in the longitudinal direction of the support member 81 are set by the magnetic core setting member 97.

As the material of each of the adjustment magnetic cores 100, a rectangular solid shaped (block shaped) ferromagnetic material formed of an oxide or an alloy material having a high permeability such as a calcinated ferrite, a ferrite resin, a non-crystalline alloy (amorphous alloy), permalloy or a temperature-sensitive magnetic alloy is used. The adjustment magnetic core 100 functions as an adjustment magnetic member that makes the magnetic field intensity in the longitudinal direction of the support member 81 averaged in the AC magnetic field formed by the magnetic cores 84 and the temperature-sensitive magnetic member 64, which are arranged around the excitation coil 82. The non-uniformity of the temperature in the width direction of the fixing belt 61 is reduced when the magnetic field intensity generated in the longitudinal direction of the support member 81 is made to be averaged. The adjustment magnetic cores 100 is arranged at space of an inner region formed between the magnetic core supporting units 81*b*1 and 81*b*2 (region surrounded by inner walls of the magnetic core supporting units 81*b*1 and 81*b*2), and the positions of the adjustment magnetic cores 100 in the longitudinal direction of the support member 81 are set by the magnetic core setting member 97.

<Description of Method of Securing Excitation Coil, Magnetic Cores and Adjustment Magnetic Cores in IH Heater>

Next, a description will be given of a method of securing the excitation coil 82, the magnetic cores 84 and the adjustment magnetic cores 100 onto the support member 81 in the IH heater 80 in the second exemplary embodiment.

Figure 13:
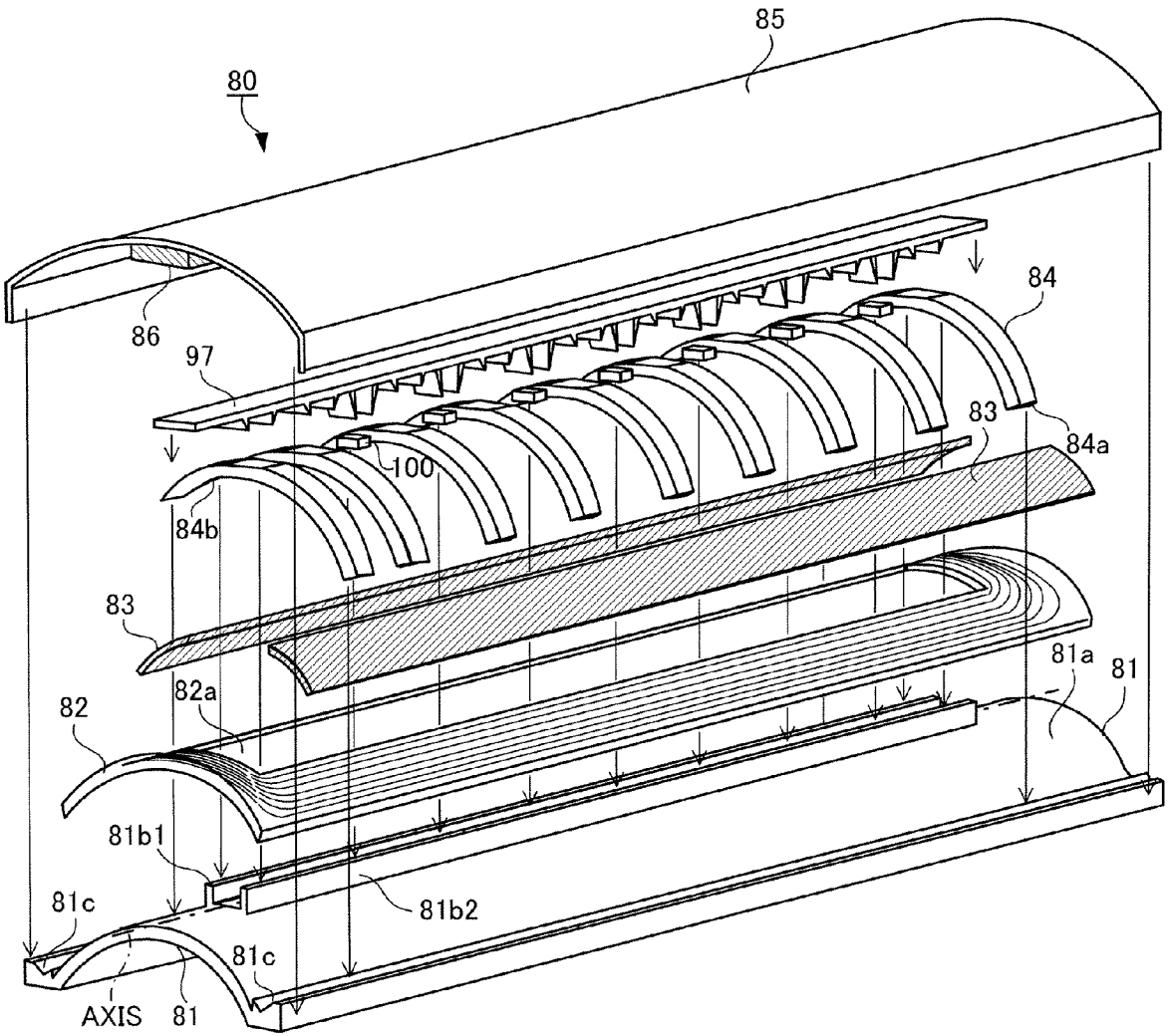
FIG. 13 is a diagram for explaining a multi-layer structure of the IH heater.

FIG. 13 is a diagram for explaining a multi-layer structure of the IH heater 80 in the second exemplary embodiment. As shown in FIG. 13, the excitation coil 82 is mounted on the supporting surface 81*a* of the support member 81 as an example of the support member so that the closed loop hollow portion 82*a* of the excitation coil 82 surrounds the pair of the magnetic core supporting units (convex portions) 81*b*1 and 81*b*2 as an example of the position setting unit arranged in parallel along the center axis in the longitudinal direction of the supporting surface 81*a*. The supporting surface 81*a* is formed as a position setting surface formed and configured so as to have the gap with the fixing belt 61 to be equal to a defined value (design value), the fixing belt 61 rotationally moving in a substantially circular orbit. The excitation coil 82 is secured so as to be in close contact with the supporting surface 81*a* by being pressed against the supporting surface 81*a* of the support member 81 by the sheet-like elastic support members 83.

Moreover, each of the multiple magnetic cores 84 arranged in the width direction of the fixing belt 61 has the inner surface on the excitation coil 82 side, which is formed as the inner circumferential side circular arc surface 84*b* having a circular arc shape toward the moving direction of the fixing belt 61. In addition, the inner circumferential side circular arc surface 84*b* of the magnetic core 84 is formed with a length enough to cover (wrap) an entire region where the excitation coil 82 is arranged in the moving direction of the fixing belt 61. Then, each of the magnetic cores 84 is configured to keep the gap between each of the magnetic cores 84 and the supporting surface 81*a* constant when the inner circumferential side circular arc surfaces 84*b* of the magnetic cores 84 are supported by the pair of the magnetic core supporting units 81*b*1 and 81*b*2 arranged in parallel along the center axis in the longitudinal direction on the supporting surface 81*a*. At this time, the magnetic cores 84 are also supported movably in the moving direction of the fixing belt 61 on the pair of the magnetic core supporting units 81*b*1 and 81*b*2 between the magnetic core regulation units 81*c* arranged respectively at the both side portions of the supporting surface 81*a* in the moving direction of the fixing belt 61. The magnetic cores 84 are also movably supported in the longitudinal direction (width direction of the fixing belt 61) of the support member 81 on the magnetic core supporting units 81*b*1 and 81*b*2.

Here, each of the sheet-like elastic support members 83 is formed of a sheet-like elastic material having a low Young's modulus such as a silicone rubber or a fluorine rubber, and arranged between the excitation coil 82 and the magnetic cores 84. Meanwhile, when the inner circumferential side circular arc surfaces 84*b* of the magnetic cores 84 are supported by the pair of the magnetic core supporting units 81*b*1 and 81*b*2 on the supporting surface 81*a*, the gap between each of the magnetic cores 84 and the supporting surface 81*a* is set at a gap set in advance (also refer to FIG. 6). In this case, the thickness of the sheet-like elastic support member 83 is formed to be larger than the gap between each of the magnetic cores 84 and the supporting surface 81*a*. Meanwhile, when the shield 85 is attached onto the support member 81, each of the magnetic cores 84 is pressed against the support member 81, via the magnetic core setting member 97, by the pressing member 86 provided for the bottom surface of the shield 85. For this reason, the sheet-like elastic support members 83 receive, via the magnetic cores 84, pressing force against the support member 81, and then, are elastically deformed (compressed). The sheet-like elastic support members 83 press the excitation coil 82 against the supporting surface 81*a* with the elastic force generated therefrom. In this manner, the sheet-like elastic support members 83 secure the excitation coil 82 so that the excitation coil 82 is in close contact with the supporting surface 81*a*. Since the supporting surface 81*a* is formed and configured so as to keep a gap set in advance (design value) with the surface of the fixing belt 61, the excitation coil 82 is configured so as to keep a gap set in advance between the entire excitation coil 82 and the surface of the fixing belt 61.

Note that, in addition to an elastic material such as a silicone rubber or a fluorine rubber, an elastic member such as a spring may be used as the pressing member 86.

Subsequently, the inner circumferential side circular arc surfaces 84*b* of the magnetic cores 84 arranged in the width direction of the fixing belt 61 are each mounted on and supported by the pair of the magnetic core supporting units 81*b*1 and 81*b*2, and thereafter, the positions of the respective magnetic cores 84 in the longitudinal direction of the support member 81 are secured by the magnetic core setting member 97. The magnetic core setting member 97 is pressed toward the support member 81 from the top thereof by the pressing member 86 provided at the bottom surface of the shield 85. Thereby, the magnetic core setting member 97 presses each of the magnetic cores 84 against the support member 81, and the position of the magnetic core setting member 97 in the longitudinal direction of the support member 81 is secured at a time. Thus, each of the magnetic cores 84 is pressed so as to be held between the pressing member 86 arranged at the top surface side of the magnetic core 84 via the magnetic core setting member 97 and the sheet-like elastic support member 83 arranged at the bottom surface side thereof. In this manner, the vertical direction of the magnetic cores 84 in the IH heater 80 is secured. In addition, the magnetic cores 84 movably supported in the longitudinal direction of the support member 81 on the pair of the magnetic core supporting units 81*b*1 and 81*b*2 are positioned so as to be secured in the longitudinal direction of the support member 81, by the magnetic core setting member 97 pressed by the pressing member 86 from the top surface side thereof. Alternatively, the magnetic cores 84 may be positioned by the support member 81 supporting the excitation coil 82. Note that, a method of securing the position of each of the magnetic cores 84 in the longitudinal direction of the support member 81 will be described later in more detail.

The multiple adjustment magnetic cores 100 arranged in the width direction of the fixing belt 61 are each formed in a rectangular solid shape (block shape), and arranged in the space formed at the inner region between the magnetic core supporting units 81*b*1 and 81*b*2. The position of each of the adjustment magnetic cores 100 inside the IH heater 80 is thereby configured.

In addition, when the adjustment magnetic cores 100 are arranged at the inner region between the magnetic core supporting units 81*b*1 and 81*b*2, the adjustment magnetic cores 100 are supported movably in the longitudinal direction (width direction of the fixing belt 61) of the support member 81. When the magnetic core setting member 97 is mounted thereon, the position of each of the adjustment magnetic cores 100 in the longitudinal direction of the support member 81 is set and secured with a corresponding one of the magnetic cores 84 by the magnetic core setting member 97. Note that, a method of securing the position of each of the adjustment magnetic cores 100 in the longitudinal direction of the support member 81 will be described later in more detail.

Next, each of the inner circumferential side circular arc surfaces 84*b* of the magnetic cores 84 arranged in the width direction of the fixing belt 61 is supported by the pair of the magnetic core supporting units 81*b*1 and 81*b*2 arranged in parallel along the center axis in the longitudinal direction on the supporting surface 81*a*.

Figure 14:
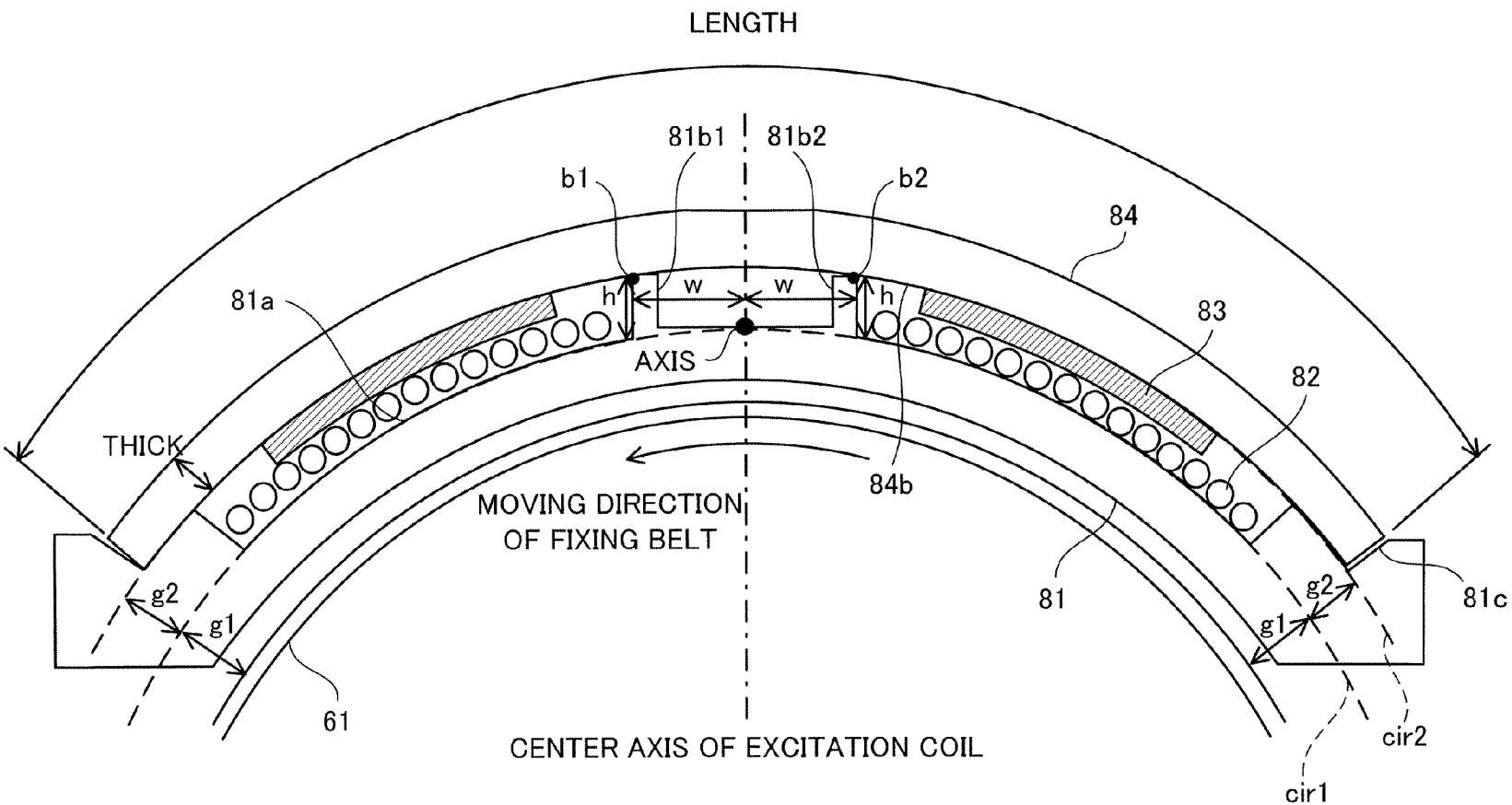
FIG. 14 is a cross sectional configuration diagram showing the state where the magnetic cores are supported by the pair of the magnetic core supporting units.

FIG. 14 is a cross sectional configuration diagram showing the state where the magnetic cores 84 are supported by the pair of the magnetic core supporting units 81*b*1 and 81*b*2. As shown in FIG. 14, the pair of the magnetic core supporting units 81*b*1 and 81*b*2 are arranged on the supporting surface 81*a* of the support member 81, the supporting surface 81*a* being formed and configured so as to keep a gap g1 set in advance with the surface of the fixing belt 61. The pair of the magnetic core supporting units 81*b*1 and 81*b*2 are arranged at positions symmetrical to each other with the center axis in the longitudinal direction of the supporting surface 81*a* (also refer to FIG. 13). Specifically, the distance between the outer wall of the magnetic core supporting unit 81*b*1 and the center axis in the longitudinal direction and the distance between the outer wall of the magnetic core supporting unit 81$b$2 and the center axis in the longitudinal direction are set to be equal (=w). In addition, the height of the outer wall of the magnetic core supporting unit 81$b$1 and the height of the outer wall of the magnetic core supporting unit 81$b$2 are set to be equal (=h).

Note that, as shown in FIG. 13, the center axis in the longitudinal direction is a straight line orthogonal to the moving direction of the fixing belt 61. In particular, the center axis in the longitudinal direction is set to be a straight line in the longitudinal direction in which the center axis of the excitation coil 82 and the supporting surface 81$a$ intersect with each other, the AC magnetic field generated by the excitation coil 82 is evenly distributed at forward and backward portions of the magnetic cores 84 in the moving direction of the fixing belt 61.

Meanwhile, the inner circumferential side circular arc surface 84$b$ of each of the magnetic cores 84 is formed to have the same center as that of a circle (cir 1) formed by the supporting surface 81$a$ (concentrically), and formed on a circle (cir 2) which is configured to have a gap g2 with the supporting surface 81$a$, when each of the magnetic cores 84 is supported by the magnetic core supporting units 81$b$1 and 81$b$2.

Accordingly, the gap g2 between the inner circumferential side circular arc surface 84$b$ of each of the magnetic cores 84 and the supporting surface 81$a$ is set no matter which position in the moving direction (circular arc direction) of the fixing belt 61 is supported by the pair of the magnetic core supporting units 81$b$1 and 81$b$2. Specifically, the inner circumferential side circular arc surface 84$b$ of each of the magnetic cores 84 is configured as a part of the circle (cir 2) drawn through a top b1 of the outer wall of the magnetic core supporting unit 81$b$1 and a top b2 of the outer wall of the magnetic core supporting unit 81$b$2. This circle (cir 2) is concentric with the supporting surface 81$a$ (=cir 1). For this reason, no matter which position of the inner circumferential side circular arc surface 84$b$ is supported by the pair of the magnetic core supporting units 81$b$1 and 81$b$2, the inner circumferential side circular arc surface 84$b$ and the circle cir 2 coincide with each other. Thus, the gap g2 is set between the inner circumferential side circular arc surface 84$b$ and the supporting surface 81$a$.

In general, non-uniformity easily occurs, by heat processing after molding, in the shape of ferrite that constitutes each of the magnetic cores 84. Accordingly, it is difficult to increase the dimensional accuracy of the magnetic core 84 formed of ferrite. However, even if the dimensional accuracy of all of the elements for determining the shape of the magnetic core 84, such as the length and the thickness of the magnetic core 84 formed of the ferrite having such characteristics may not be increased, only the inner circumferential side circular arc surface 84$b$, which is a part of the magnetic core 84, is formable with high accuracy. Therefore, in the second exemplary embodiment, the inner circumferential side circular arc surface 84$b$ is set as a reference position of the magnetic core 84, and by the aforementioned configuration using the inner circumferential side circular arc surface 84$b$, the positional accuracy between each of the magnetic cores 84 and the excitation coil 82 is increased.

In addition, at this time, the inner circumferential side circular arc surface 84$b$ of the magnetic core 84 is formed with a length (refer to FIG. 14) in the moving direction of the fixing belt 61 so as to cover (wrap) the entire region where the excitation coil 82 is arranged in the moving direction of the fixing belt 61. If a part of the arrangement region of the excitation coil 82 is located outside the inner circumferential side circular arc surface 84$b$, magnetic field lines (magnetic fluxes) that are not induced to the inside of the magnetic cores 84 occur in the AC magnetic field generated by the excitation coil 82, resulting in a decrease in the number of magnetic fluxes induced to the inside of the magnetic cores 84. In this case, the heat generating efficiency in the fixing belt 61 (conductive heat generating layer 612) decreases. For this reason, the length of the inner circumferential side circular arc surface 84$b$ is formed so as to cover the entire arrangement region of the excitation coil 82.

At this time, it is also difficult to achieve a high dimensional accuracy for the length of the magnetic core 84 because of the aforementioned reason. However, it is easy to achieve a dimensional accuracy in a relatively broad range where the length of the magnetic core 84 is not less than the length to cover the entire arrangement region of the excitation coil 82 and shorter than a distance between the magnetic core regulation units 81$c$ arranged at the respective sides of the supporting surface 81$a$ in the moving direction of the fixing belt 61. Accordingly, the magnetic core 84 is manufactured while the dimensional accuracy in the range where the length of the magnetic core 84 is not less than the length to cover the entire arrangement region of the excitation coil 82 and shorter than a distance between the magnetic core regulation units 81$c$ is allowed. Then, the magnetic core 84 is supported, by the pair of the magnetic core supporting units 81$b$1 and 81$b$2, movably in the moving direction of the fixing belt 61 between the magnetic core regulation units 81$c$ as an example of a regulation unit, arranged at the both sides of the supporting surface 81$a$, respectively.

Thereby, even if the dimensional accuracy for the length of each of the magnetic cores 84 is set within the relatively broad range, the magnetic core 84 is arranged within a region between the magnetic core regulation units 81$c$ arranged on the supporting surface 81$a$. Thus, even if the lengths of the magnetic cores 84 vary within the relatively broad range of the dimensional accuracy, and no matter which position of the inner circumferential side circular arc surface 84$b$ of each of the magnetic cores 84 is supported by the pair of the magnetic core supporting units 81$b$1 and 81$b$2, the gap g2 is set between the inner circumferential side circular arc surface 84$b$ and the supporting surface 81$a$, as described above. Moreover, the magnetic cores 84 are arranged so as to cover the entire arrangement region of the excitation coil 82.

Thus, the positional accuracy between the magnetic cores 84 and the excitation coil 82 increases, and the AC magnetic field generated by the excitation coil 82 is efficiently induced to the inside of the magnetic cores 84. In addition, because of the increase in the positional accuracy between the magnetic cores 84 and the excitation coil 82, the magnetic cores 84 evenly press the sheet-like elastic support members 83 in the longitudinal direction, thereby, further increasing the adhesiveness between the excitation coil 82 and the supporting surface 81$a$ in the longitudinal direction.

Meanwhile, even if the lengths of the magnetic cores 84 vary within the distance between the magnetic core regulation units 81$c$, and no matter which positions the magnetic cores 84 are arranged in the moving direction (circular arc direction) of the fixing belt 61, only the positions of the regions R1 and R2 where the fixing belt 61 (conductive heat generating layer 612) is heated as shown in FIG. 7 slightly move in the circular arc direction. Thus, the influence on the heat generating efficiency of the conductive heat-generating layer 612 is small.

<Description of Method of Setting Positions of Magnetic Cores and Adjustment Magnetic Cores in Longitudinal Direction in IH Heater>

Next, a description will be given of a method of setting positions of the magnetic cores 84 and the adjustment magnetic cores 100 in the longitudinal direction of the support member 81 in the IH heater 80 of the second exemplary embodiment.

As described above, the positions of the magnetic cores 84 and the adjustment magnetic cores 100 with respect to the excitation coil 82 in a layer direction are set by the support member 81 (pair of the magnetic core supporting units 81*b*1 and 81*b*2) as an example of the support member. Meanwhile, when the magnetic cores 84 are arranged at the outer walls of the magnetic core supporting units 81*b*1 and 81*b*2, the magnetic cores 84 are movably supported in the longitudinal direction of the support member 81. Likewise, when the adjustment magnetic cores 100 are arranged at the inner regions (the area surrounded by the inner walls of the magnetic core supporting units 81*b*1 and 81*b*2) of the magnetic core supporting units 81*b*1 and 81*b*2, the adjustment magnetic cores 100 are movably supported in the longitudinal direction of the support member 81. Further, for the magnetic cores 84 and the adjustment magnetic cores 100 movably supported in the longitudinal direction of the support member 81, the magnetic core setting member 97 as an example of the position setting member sets and secures the positions thereof in the longitudinal direction of the support member 81. Specifically, when the magnetic cores 84 and the adjustment magnetic cores 100 are arranged on the magnetic core supporting units 81*b*1 and 81*b*2, the magnetic cores 84 and the adjustment magnetic cores 100 are freely movable in the longitudinal direction. Then, the positions of the magnetic cores 84 and the adjustment magnetic cores 100 in the longitudinal direction are secured, in accordance with an arrangement configuration of longitudinal direction position setting members provided on the magnetic core setting member 97, at the arrangement positions of the longitudinal direction position setting members.

Figure 15:
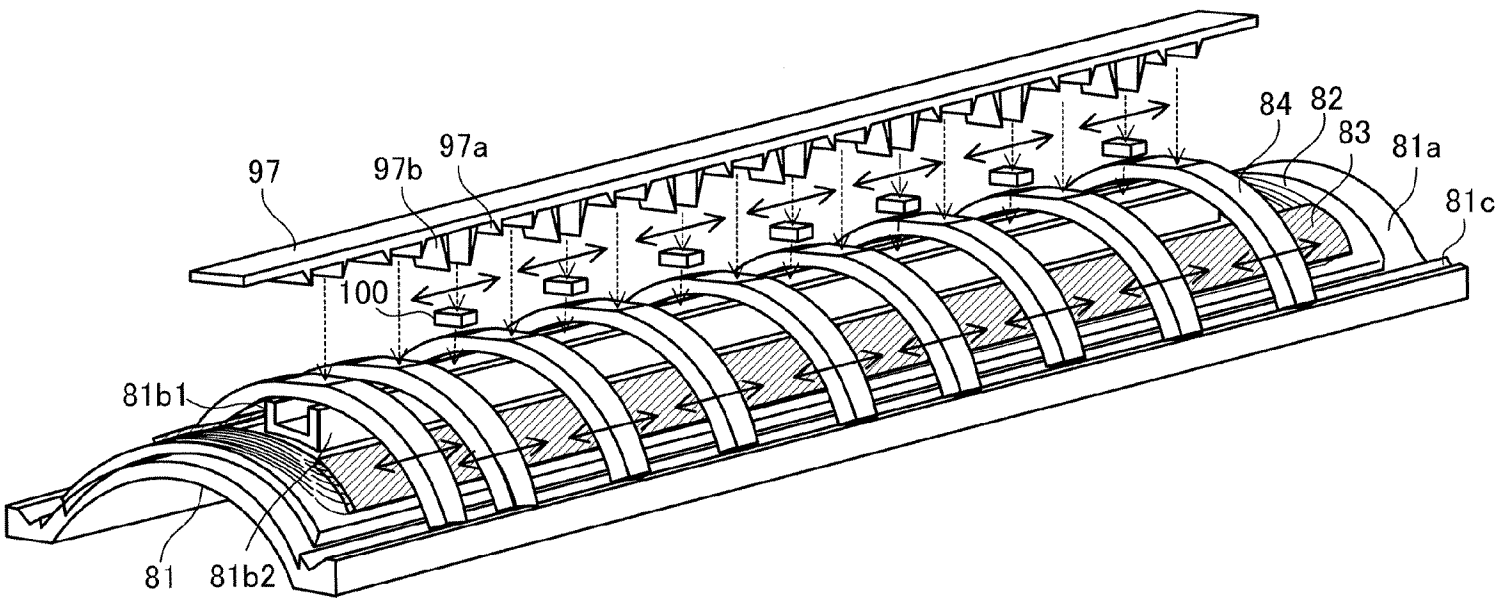
FIG. 15 is a perspective view for explaining a state where the magnetic core setting member sets the positions of the magnetic cores and the adjustment magnetic cores in the longitudinal direction.

FIG. 15 is a perspective view for explaining a state where the magnetic core setting member 97 sets the positions of the magnetic cores 84 and the adjustment magnetic cores 100 in the longitudinal direction. As shown in FIG. 15, the magnetic cores 84 are provided, with the sheet-like elastic support members 83 interposed between each of the magnetic cores 84 and the support member 81, on the support member 81 including the excitation coil 82 provided on the supporting surface 81*a*. Each of the magnetic cores 84 is supported by the outer walls of the magnetic core supporting units 81*b*1 and 81*b*2. However, at this stage, members that regulate movement of the magnetic cores 84 in the longitudinal direction (arrows indicated with solid lines in FIG. 15) of the support member 81 are not provided on the support member 81 yet. For this reason, the magnetic cores 84 are supported by the outer walls of the magnetic core supporting units 81*b*1 and 81*b*2 in the state of being freely movable in the longitudinal direction.

The adjustment magnetic cores 100 are supported at the inner wall sides of the magnetic core supporting units 81*b*1 and 81*b*2. However, at this stage, members that regulate movement of the adjustment magnetic cores 100 in the longitudinal direction (indicated by arrows with solid lines in FIG. 15) of the support member 81 are not provided on the support member 81 yet. For this reason, the adjustment magnetic cores 100 are supported by the inner walls of the magnetic core supporting units 81*b*1 and 81*b*2 in the state of being freely movable in the longitudinal direction.

In this state, the magnetic core setting member 97 is placed from the above of the magnetic cores 84 and the adjustment magnetic cores 100 (indicated by arrows with broken lines in FIG. 15). At the bottom surface (surface on the support member 81 side) of the magnetic core setting member 97, first longitudinal direction position setting units 97*a* and second longitudinal direction position setting units 97*b* are arranged respectively for the multiple magnetic cores 84 and adjustment magnetic cores 100 arranged in the IH heater 80. Each of the first longitudinal direction position setting units 97*a* sets the longitudinal direction position of a corresponding one of the magnetic cores 84, and each of the second longitudinal direction position setting units 97*b* sets the longitudinal direction position of a corresponding one of the adjustment magnetic cores 100.

Thereby, when the magnetic core setting member 97 is provided, the longitudinal direction position of each of the magnetic cores 84 is set at a position having been set in advance, by a corresponding one of the first longitudinal direction position setting units 97*a*. Likewise, the longitudinal direction position of each of the adjustment magnetic cores 100 is set at a position having been set in advance, by a corresponding one of the second longitudinal direction position setting units 97*b*.

Specifically, by selecting the arrangement positions of the first longitudinal direction position setting units 97*a* and the second longitudinal direction position setting units 97*b* on the magnetic core setting member 97, the longitudinal direction position of each of the magnetic cores 84 and the longitudinal direction position of each of the adjustment magnetic cores 100 are freely configured without being regulated by the support member 81. In addition, the longitudinal direction positions of the magnetic cores 84 and the adjustment magnetic cores 100 are configurable while the number of the magnetic cores 84 and the number of the adjustment magnetic cores 100 are increased or decreased.

In general, tolerances in design (variances within an allowable range in manufacturing) exist for the positional relationship between the constituent elements such as the fixing belt 61 and the excitation coil 82, or the arrangement positions of the constituent elements such as the fixing belt 61 and the temperature-sensitive magnetic member 64. Thus, the resistance (R) and the inductance (L) of the electric circuit system configured of the excitation coil 82 and the excitation circuit 88 include different variance regions in accordance with the configurations of the fixing unit 60. For this reason, when the excitation circuit 88 that supplies a drive power to the excitation coil 82 is designed, the excitation circuit 88 is designed while a withstanding voltage or short-circuit current of a circuit element such as a transistor forming the excitation circuit 88 is estimated in accordance with the variances of the resistance (R) and the inductance (L) of the electric circuit system. Thus, normally, for each of the configurations of the fixing unit 60, the excitation circuit 88 having a different specification is designed.

Figure 16:
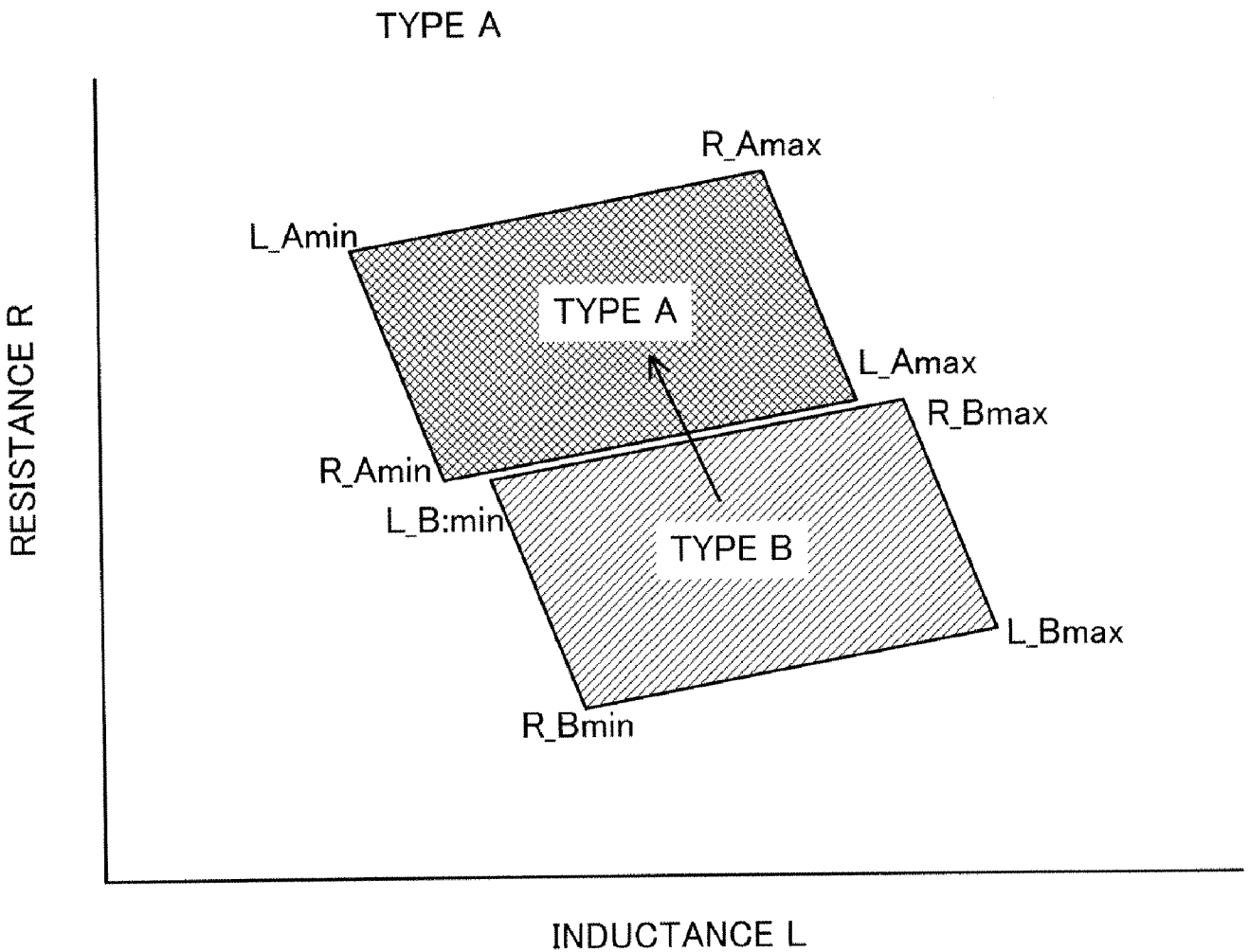
FIG. 16 is a diagram for exemplifying tolerance ranges of the excitation circuit designed in accordance with variances of the resistance and the inductance in the fixing units of different configurations.

FIG. 16 is a diagram for exemplifying tolerance ranges of the excitation circuit 88 designed in accordance with variances of the resistance (R) and the inductance (L) in the fixing units 60 of different configurations.

As shown in FIG. 16, in the fixing unit 60 of a type A, the excitation circuit 88 having a specification corresponding to a range from R_Amax to R_Amin, which is the variance range of the resistance R, and a range from L-Amax to L_Amin, which is the variance range of the inductance L is designed. In addition, in the fixing unit 60 of a type B, the excitation circuit 88 having a specification corresponding to a range from R_Bmax to R_Bmin, which is the variance range of the resistance R, and a range from L-Bmax to L_Bmin, which is the variance range of the inductance L is designed.

However, in this case, the excitation circuits 88 corresponding to the fixing units 60 of types A and B have different specifications, so that they are incompatible with one another. In addition, the costs for designing and manufacturing the excitation circuits 88 having different specifications lead to an increase in manufacturing costs.

In this respect, in the IH heater 80 of the second exemplary embodiment, in order to make the fixing units 60 having different configurations have the similar variance ranges of the resistance R and the similar variance ranges of the inductance L, the longitudinal direction positions of each of the magnetic cores 84 and each of the adjustment magnetic cores 100 are freely configurable, and the numbers of the magnetic cores 84 and the adjustment cores 100 are also changeable.

By changing the longitudinal direction positions of or the numbers of the magnetic cores 84 and the adjustment magnetic cores 100, the resistance R and the inductance L of the electric circuit system configured of the excitation coil 82 and the excitation circuit 88 are adjusted. When the longitudinal direction positions of or the numbers of the magnetic cores 84 and the adjustment magnetic cores 100 of any one of or both of the fixing units 60 are changed so as to make the fixing units 60 of different configurations have the similar resistances R and the similar inductances L, a mutual compatibility in the excitation circuit 88 is achieved. For example, when the longitudinal direction positions of or the numbers of the magnetic cores 84 and the adjustment magnetic cores 100 are set so as to make the variance range of the resistance R and the variance range of the inductance L of the fixing unit 60 of the type B in FIG. 16 approximated by the variance range of the resistance R and the variance range of the inductance L of the fixing unit 60 of the type A, the magnetic circuit 88 designed for the fixing unit 60 of the type A becomes usable in the fixing unit 60 of the type B. Specifically, when the number of the adjustment magnetic cores 100 to be arranged is increased, the resistance R and the inductance L tend to become larger. For this reason, by adjusting the longitudinal direction positions or the number of the adjustment magnetic cores 100 in the fixing unit 60 of type B, the variance range of the resistance R and the variance range of the inductance L of the fixing unit 60 of type B, for example, are made to be approximated by the variance range of the resistance R and the variance range of the inductance L of the fixing unit 60 of type A.

For this reason, in the IH heater 80 of the second exemplary embodiment, the longitudinal direction positions of the magnetic cores 84 and the adjustment magnetic cores 100 are freely configurable. Moreover, the numbers of the magnetic cores 84 and the adjustment magnetic cores 100 are changeable when the magnetic cores 84 and the adjustment magnetic cores 100 are set. Thereby, the excitation circuit 88 is made to be commonly usable in the fixing units 60 having different configurations since the electric circuit systems each configured of the excitation coil 82 and the excitation circuit 88 are made to have the similar variance ranges of the resistance R as well as the similar variance ranges of the inductance L.

Figures 17A, 17B:
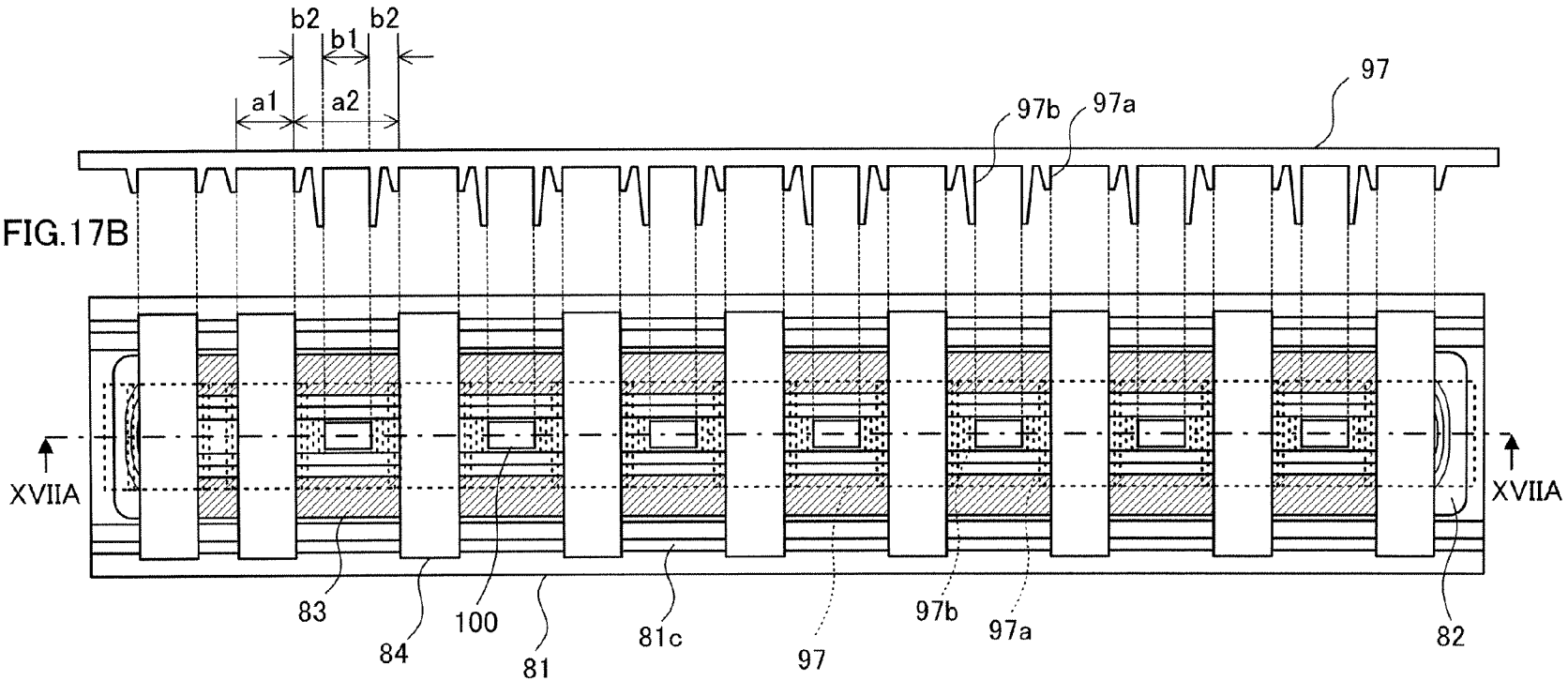
FIGS. 17A and 17B are diagrams showing configuration examples of the IH heater.
Figures 18A, 18B:
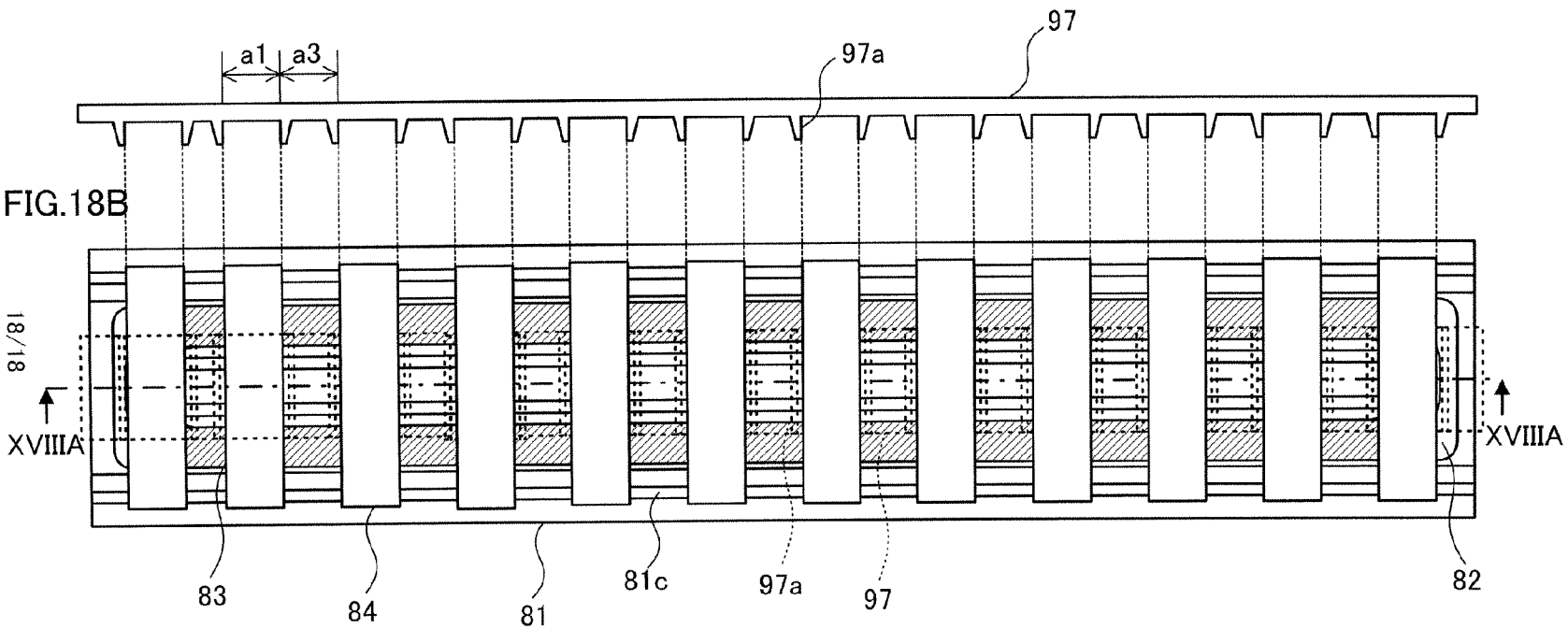
FIGS. 18A and 18B are diagrams showing configuration examples of the IH heater.

For example, FIGS. 17A and 17B, and 18A and 18B are diagrams showing configuration examples of the IH heater 80 in which the longitudinal direction positions of or the numbers of the magnetic cores 84 and the adjustment magnetic cores 100 are configured in order that the electric circuit systems each configured of the excitation coil 82 and the excitation circuit 88 may have the similar variance ranges of the resistance R and the similar variance ranges of the inductance L. Note that, FIGS. 17B and 18B are plain views of the IH heater 80 without the shield 85. FIG. 17A is a cross sectional view of the magnetic core setting member 97 taken along the line XVIIA-XVIIA of FIG. 17B, and FIG. 18A is a cross sectional view of the magnetic core setting member 97 taken along the line XVIIIA-XVIIIA of FIG. 18B.

Firstly, in the IH heater 80 of the configuration shown in FIGS. 17A and 17B, nine magnetic cores 84 each having a width a1 are arranged so as to have an interval a2 between adjacent magnetic cores 84, and seven adjustment magnetic cores 100 each having a width b1 are arranged between adjacent magnetic cores 84 so as to have an interval b2 between each of the seven adjustment magnetic cores 100 and adjacent one of the magnetic cores 84. However, the interval between the adjacent magnetic cores 84 positioned on the left end side in FIG. 17A is made shorter than the interval a2 in order to suppress a decrease in the magnetic field at the left end portion.

In order to set the longitudinal direction positions of the magnetic cores 84 and the adjustment magnetic cores 100 described above, the first longitudinal direction position setting units 97*a* and the second longitudinal direction position setting units 97*b* are arranged on the magnetic core setting member 97. Specifically, the first longitudinal direction position setting units 97*a* and the second longitudinal direction position setting units 97*b* are arranged on the magnetic core setting member 97. Here, the first longitudinal direction position setting units 97*a* sets the magnetic cores 84 each having the width a1 to be arranged with the intervals a2 with the adjacent magnetic core 84 except the magnetic core 84 on the left end side in FIGS. 17A and 17B, and the second longitudinal direction position setting units 97*b* sets the adjustment magnetic cores 100 each having the width b1 to have intervals b2 with the adjacent magnetic core 84 except the magnetic core 84 on the left end side in FIGS. 17A and 17B.

Meanwhile, in the IH heater 80 of the configuration shown in FIGS. 18A and 18B, twelve magnetic cores 84 each having a width a1 are arranged so as to have an interval a3 between the adjacent magnetic cores 84, and the adjustment magnetic cores 100 are not arranged. However, as in the case of FIGS. 17A and 17B, the mutual distance between the magnetic cores 84 on the left end side is set shorter than the interval a3 in order to suppress a decrease in the magnetic field on the left end side.

The first longitudinal direction position setting units 97*a* are arranged on the magnetic core setting member 97 for setting the longitudinal direction positions of the aforementioned magnetic cores 84, and the second longitudinal direction position setting units 97*b* are not arranged. Specifically, only the first longitudinal direction position setting units 97*a* are arranged on the magnetic core setting member 97, and the first longitudinal direction position setting units 97*a* sets the magnetic cores 84 each having the width a1 to be arranged with the intervals a3 with the adjacent magnetic core 84, except the magnetic core 84 on the left edge side in FIGS. 18A and 18B.

In this case, the IH heater 80 having the configuration shown in FIGS. 17A and 17B and the IH heater 80 having the configuration shown in FIGS. 18A and 18B are the same except the longitudinal direction positions of and the numbers of the magnetic cores 84 and adjustment magnetic cores 100, the presence or absence of installation of the adjustment magnetic cores 100, and the arrangement configurations of the first longitudinal direction position setting units 97*a* and the second longitudinal direction position setting units 97*b* on the magnetic core setting member 97 corresponding to these differences. In other words, the support member 81, the excitation coil 82, the sheet-like elastic support member 83, the shield 85, the pressing member 86 and the excitation circuit 88 in each of the IH heater 80 having the configuration shown in FIGS. 17A and 17B and the IH heater 80 having the configuration shown in FIGS. 18A and 18B are configured in the same manner. In addition, the shapes and sizes of the magnetic cores 84 and the adjustment magnetic cores 100 are configured in the same manner.

Then, in accordance with the entire or a partial difference of the configurations of the fixing units 60 except the IH heaters 80, the longitudinal direction positions of the magnetic cores 84 and adjustment magnetic cores 100, and moreover, the numbers of the magnetic cores 84 and the adjustment magnetic cores 100 are set so that the electric circuit systems each configured of the excitation coil 82 and the excitation circuit 88 are made to have the similar variance ranges of the resistance R and the similar variance ranges of the inductance L.

For the purpose of implementing the arrangement configurations of the above described magnetic cores 84 and adjustment magnetic cores 100, in the IH heater 80 of the second exemplary embodiment, the longitudinal direction positions of the magnetic cores 84 and adjustment magnetic cores 100 are freely configurable, and moreover, the magnetic cores 84 and adjustment magnetic cores 100 are configurable while the numbers of the magnetic cores 84 and adjustment magnetic cores 100 are increased or decreased.

Note that, in the configuration examples of the IH heater 80, which are respectively shown in FIGS. 17A and 17B and 18A and 18B, the configuration examples where the numbers of the magnetic cores 84 are different are shown. However, when the variance ranges of the resistance R and the variance ranges of the inductance L are made to be approximated by respective fixed ranges, configurations having the same number of the magnetic cores 84 and having an only difference in presence or absence of the adjustment magnetic cores 100 may be given.

In addition, the longitudinal direction positions of and the number of the adjustment magnetic cores 100 are also configured for the purpose of increasing uniformity of the AC magnetic field in the longitudinal direction of the support member 81, the AC magnetic field generated in the IH heater 80.

As described above, the IH heater 80 of the second exemplary embodiment is configured to allow the longitudinal direction positions of the magnetic cores 84 and the adjustment magnetic cores 100 to be freely set, and to allow the numbers of the magnetic cores 84 and the adjustment magnetic cores 100 to be increased or decreased. Thereby, the excitation circuit 88 is made to be commonly usable in the fixing units 60 having different configurations since the electric circuit systems each configured of the excitation coil 82 and the excitation circuit 88 are made to have the similar variance ranges of the resistance R as well as the similar variance ranges of the inductance L.

Note that, in the second exemplary embodiment, the description has been given of the fixing unit 60 in which the temperature-sensitive magnetic member 64 and the fixing belt 61 are arranged without being in contact with each other, and the temperature-sensitive magnetic member 64 does not easily generate heat in itself. However, the IH heater 80 of the second exemplary embodiment is employable in a fixing unit 60 having a configuration in which the temperature-sensitive magnetic member 64 and the fixing belt 61 are arranged to be in contact with each other, and the temperature-sensitive magnetic member 64 generates heat in itself.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a fixing member comprising a conductive layer configured to heat by electromagnetic induction;

a magnetic field generating member that generates an alternate-current magnetic field intersecting with the conductive layer of the fixing member;

a plurality of magnetic path forming members that form a magnetic path of the alternate-current magnetic field generated by the magnetic field generating member;

a support member that supports the magnetic field generating member;

an elastic support member that is arranged between the magnetic field generating member and the plurality of magnetic path forming members to be in contact with the plurality of magnetic path forming members;

a pressing member that presses the plurality of magnetic path forming members toward the magnetic field generating member;

a second support member that supports the plurality of magnetic path forming members such that the plurality of magnetic path forming members are movable in a width direction of the fixing member; and a position setting member that sets and secures each of the magnetic path forming members at a position set in advance in the width direction of the fixing member, each of the magnetic path forming members being movably supported by the second support member.

2. The fixing device according to claim 1, wherein the plurality of magnetic path forming members are pressed by the pressing member toward the support member, and are secured by being pressed to be held between the pressing member and the elastic support member.

3. The fixing device according to claim 1, wherein the elastic support member presses the magnetic field generating member toward the support member with elastic force generated by pressing force received from the pressing member via the plurality of magnetic path forming members.

4. The fixing device according to claim 1, further comprising:

a shield member that shields the alternate-current magnetic field generated by the magnetic field generating member and that is attached to the support member to hold the pressing member with the plurality of magnetic path forming members, wherein the plurality of magnetic path forming members are pressed toward the support member by the pressing member.

5. The fixing device according to claim 1, further comprising:

a plurality of adjustment magnetic members that are arranged in the width direction of the fixing member, and that adjust the alternate-current magnetic field generated by the magnetic field generating member to be averaged in the width direction of the fixing member, wherein the second support member supports the plurality of adjustment magnetic members such that the plurality of adjustment magnetic members are movable in the width direction of the fixing member, and wherein the position setting member sets and secures each of the adjustment magnetic members at a position set in advance in the width direction of the fixing member, each of the adjustment magnetic members being movably supported by the second support member.

6. The fixing device according to claim 1, wherein:

the second support member comprises:

a position setting surface that sets the magnetic field generating member at a position having a gap set in advance with the fixing member; and a position setting unit that sets each of the magnetic path forming members at a position having a gap set in advance with the position setting surface while supporting the plurality of magnetic path forming members such that the plurality of magnetic path forming members are movable in the width direction of the fixing member; and the position setting unit of the second support member is formed of a pair of convex portions arranged in parallel along a direction orthogonal to a moving direction of the fixing member, and supports the plurality of magnetic path forming members such that the plurality of magnetic path forming members are movable along the position setting surface forward and backward in the moving direction of the fixing member.

7. The fixing device according to claim 1, further comprising an opposed magnetic path forming member that is arranged to oppose the magnetic field generating member while the fixing member is interposed between the opposed magnetic path forming member and the magnetic field generating member, that forms a magnetic path of the alternate-current magnetic field generated by the magnetic field generating member when temperature of the opposed magnetic path forming member is within a temperature range up to a permeability change start temperature at which permeability starts to decrease, and that allows the alternate-current magnetic field generated by the magnetic field generating member to go through the opposed magnetic path forming member when temperature of the opposed magnetic path forming member is within a temperature range exceeding the permeability change start temperature.

8. A fixing device, comprising:

a support member;

a magnetic field generating member that is stacked on the support member and that generates an alternate-current magnetic field;

an elastic support member that is stacked on the magnetic field generating member and that is arranged between the magnetic field generating member and a plurality of magnetic path forming members while being in contact with the plurality of magnetic path forming members, the plurality of magnetic path forming members forming a magnetic path of the alternate-current magnetic field generated by the magnetic field generating member;

a pressing member that is stacked to press the plurality of magnetic path forming members, the plurality of magnetic path forming members being stacked while being in contact with the elastic support member;

a shield member that is stacked on the pressing member to cause the pressing member to press the plurality of magnetic field generating members, and that shields the alternate-current magnetic field generated by the magnetic field generating member; and a second support member that is arranged to be stacked between the plurality of magnetic path forming members and the pressing member and that supports the plurality of magnetic path forming members such that the plurality of magnetic path forming members are movable in a width direction of the support member.

9. An image forming apparatus, comprising:

a toner image forming unit that forms a toner image;

a transfer unit that transfers the toner image formed by the toner image forming unit onto a recording medium; and a fixing unit that fixes, onto the recording medium, the toner image transferred onto the recording medium, wherein the fixing unit comprises:

a fixing member comprising a conductive layer configured to heat by electromagnetic induction;

a magnetic field generating member that generates an alternate-current magnetic field intersecting with the conductive layer of the fixing member;

a plurality of magnetic path forming members that form a magnetic path of the alternate-current magnetic field generated by the magnetic field generating member;

a support member that supports the magnetic field generating member;

an elastic support member that is arranged between the magnetic field generating member and the plurality of magnetic path forming members to be in contact with the plurality of magnetic path forming members, and that elastically deforms while pressing the magnetic field generating member toward the support member and then secures the magnetic field generating member onto the support member;

a pressing member that presses the plurality of magnetic path forming members toward the magnetic field generating member;

a second support member that supports the plurality of magnetic path forming members such that the plurality of magnetic path forming members are movable in a width direction of the fixing member; and a position setting member that sets and secures each of the magnetic path forming members at a position set in advance in the width direction of the fixing member, each of the magnetic path forming members being movably supported by the second support member.

10. The image forming apparatus according to claim 9, wherein:

the plurality of magnetic path forming members of the fixing unit are secured by being pressed and held between the pressing member and the elastic support member; and the elastic support member presses the magnetic field generating member toward the support member with elastic force generated by pressing force received from the pressing member.

11. The image forming apparatus according to claim 9, further comprising:

a plurality of adjustment magnetic members that are arranged in the width direction of the fixing member, and that adjust the alternate-current magnetic field generated by the magnetic field generating member to be averaged in the width direction of the fixing member, wherein the second support member of the fixing unit supports the plurality of adjustment magnetic members such that the plurality of adjustment magnetic members are movable in the width direction of the fixing member, and wherein the position setting member of the fixing unit sets and secures each of the adjustment magnetic members at a position set in advance in the width direction of the fixing member, each of the adjustment magnetic members being movably supported by the second support member.

12. The image forming apparatus according to claim 9, wherein:

the second support member of the fixing unit comprises a position setting surface that sets the magnetic field generating member at a position having a gap set in advance with the fixing member, and a position setting unit that sets each of the magnetic path forming members at a position having a gap set in advance with the position setting surface while supporting the plurality of magnetic path forming members such that the plurality of magnetic path forming members are movable in the width direction of the fixing member; and the position setting unit of the second support member is formed of a pair of convex portions arranged in parallel along a direction orthogonal to a moving direction of the fixing member, and supports the plurality of magnetic path forming members such that the plurality of magnetic path forming members are movable along the position setting surface forward and backward in the moving direction of the fixing member.

13. The image forming apparatus according to claim 9, wherein the fixing unit further comprises an opposed magnetic path forming member that is arranged to oppose the magnetic field generating member while the fixing member is interposed between the opposed magnetic path forming member and the magnetic field generating member, that forms a magnetic path of the alternate-current magnetic field generated by the magnetic field generating member when temperature of the opposed magnetic path forming member is within a temperature range up to a permeability change start temperature at which permeability starts to decrease, and that allows the alternate-current magnetic field generated by the magnetic field generating member to go through the opposed magnetic path forming member when temperature of the opposed magnetic path forming member is within a temperature range exceeding the permeability change start temperature.

14. A magnetic field generating device, comprising:

a magnetic field generating member that generates an alternate-current magnetic field intersecting with a conductive layer of a fixing member, the conductive layer configured to heat by electromagnetic induction;

a plurality of magnetic path forming members that form a magnetic path of the alternate-current magnetic field generated by the magnetic field generating member;

a support member that supports the magnetic field generating member;

an elastic support member that is arranged between the magnetic field generating member and the plurality of magnetic path forming members to be in contact with the plurality of magnetic path forming members, and that elastically deforms while pressing the magnetic field generating member toward the support member and then secures the magnetic field generating member onto the support member;

a pressing member that presses the plurality of magnetic path forming members toward the magnetic field generating member;

a second support member that supports the plurality of magnetic path forming members such that the plurality of magnetic path forming members are movable in a width direction of the fixing member; and a position setting member that sets and secures each of the magnetic path forming members at a position set in advance in the width direction of the fixing member, each of the magnetic path forming members being movably supported by the second support member.

15. The magnetic field generating device according to claim 14, further comprising:

a plurality of adjustment magnetic members that are arranged in the width direction of the fixing member, and that adjust the alternate-current magnetic field generated by the magnetic field generating member to be averaged in the width direction of the fixing member, wherein the second support member supports the plurality of adjustment magnetic members such that the plurality of adjustment magnetic members are movable in the width direction of the fixing member, and wherein the position setting member sets and secures each of the adjustment magnetic members at a position set in advance in the width direction of the fixing member, each of the adjustment magnetic members being movably supported by the second support member.

16. The magnetic field generating device according to claim 14, wherein:

the second support member comprises:

a position setting surface that sets the magnetic field generating member at a position having a gap set in advance with the fixing member; and a position setting unit that sets each of the magnetic path forming members at a position having a gap set in advance with the position setting surface while supporting the plurality of magnetic path forming members such that the plurality of magnetic path forming members are movable in the width direction of the fixing member; and the position setting unit of the second support member is formed of a pair of convex portions arranged in parallel along a direction orthogonal to a moving direction of the fixing member, and supports the plurality of magnetic path forming members such that the plurality of magnetic path forming members are movable along the position setting surface forward and backward in the moving direction of the fixing member.

* * * * *